US007733003B2

(12) United States Patent
Hiroki et al.

(10) Patent No.: US 7,733,003 B2
(45) Date of Patent: Jun. 8, 2010

(54) IMAGE FORMING APPARATUS WITH REDUCED LOSS OF ELECTRON SOURCE CAUSED BY THE INERT GAS

(75) Inventors: Tamayo Hiroki, Kanagawa-Ken (JP); Hisanobu Azuma, Kanagawa-Ken (JP); Hirotomo Taniguchi, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 561 days.

(21) Appl. No.: 11/253,584

(22) Filed: Oct. 20, 2005

(65) Prior Publication Data

US 2006/0087220 A1 Apr. 27, 2006

(30) Foreign Application Priority Data

Oct. 26, 2004 (JP) ..... 2004-310740

(51) Int. Cl.
*H01J 63/08* (2006.01)

(52) U.S. Cl. ..... 313/495; 313/553; 313/558

(58) Field of Classification Search ..... 313/495–512, 313/306, 308–311, 292–304, 552–562, 351, 313/355; 445/29–51; 428/77; 257/167, 257/10–11; 438/20; 315/169.1, 169.3
See application file for complete search history.

(56) References Cited

U.S. PATENT DOCUMENTS 5,223,766 A 6/1993 Nakayama et al. ..... 313/495
5,594,296 A 1/1997 Mitsutake et al. ..... 313/309
5,594,298 A 1/1997 Itoh et al. ..... 313/336
5,633,560 A 5/1997 Huang ..... 313/495
5,679,960 A * 10/1997 Akama ..... 257/10
6,034,468 A * 3/2000 Wilshaw ..... 313/309
6,107,745 A * 8/2000 Mougin et al. ..... 315/169.1
6,153,973 A * 11/2000 Shibata et al. ..... 313/495
6,246,168 B1 6/2001 Kishi et al. ..... 313/495
6,252,294 B1 * 6/2001 Hattori et al. ..... 257/620
6,306,001 B1 10/2001 Hiroki ..... 445/6
6,313,815 B1 11/2001 Takeda et al. ..... 345/75.2
6,489,720 B1 * 12/2002 Gofuku et al. ..... 313/558

(Continued)

FOREIGN PATENT DOCUMENTS

CN 1108796 9/1995

(Continued)

OTHER PUBLICATIONS

European Search Report dated Mar. 23, 2009, regarding Application No. 08011938.1-2208.

(Continued)

*Primary Examiner*—Joseph L Williams
*Assistant Examiner*—Fatima N Farokhrooz
(74) *Attorney, Agent, or Firm*—Fitzpatrick, Cella, Harper & Scinto

(57) ABSTRACT

An image forming apparatus in which a first substrate provided with an electron-emitting device and an image displaying member which electrons emitted from the electron-emitting device irradiate are arranged to be opposed is provided with a deflecting means deflecting the electrons emitted from the electron-emitting device and a trapping unit trapping an inert gas ionized by the electrons. Thereby, the damages of the electron-emitting device by the inert gas are prevented, and the life of an image display apparatus is aimed to be elongated.

8 Claims, 16 Drawing Sheets

U.S. PATENT DOCUMENTS

| | | | | |
|---|---|---|---|---|
| 6,559,596 | B1 * | 5/2003 | Arai et al. | 313/553 |
| 6,626,718 | B2 | 9/2003 | Hiroki | 445/6 |
| 6,703,791 | B2 | 3/2004 | Azuma | 315/169.3 |
| 6,784,613 | B2 | 8/2004 | Tokioka et al. | |
| 6,958,264 | B1 * | 10/2005 | Lin | 438/143 |
| 6,972,203 | B2 | 12/2005 | Azuma | 438/20 |
| 2001/0006842 | A1 * | 7/2001 | Hattori | 438/584 |
| 2001/0017526 | A1 * | 8/2001 | Abe et al. | 315/169.3 |
| 2002/0084736 | A1 * | 7/2002 | Shibata | 313/310 |
| 2002/0109460 | A1 * | 8/2002 | Hasegawa et al. | 313/555 |
| 2002/0195924 | A1 | 12/2002 | Raina | 313/495 |
| 2003/0038597 | A1 | 2/2003 | Tokioka et al. | |
| 2003/0222570 | A1 * | 12/2003 | Kishi et al. | 313/495 |
| 2004/0150044 | A1 * | 8/2004 | Nagano et al. | 257/347 |
| 2005/0040752 | A1 | 2/2005 | Lee | 313/495 |
| 2005/0266761 | A1 | 12/2005 | Azuma | 445/5 |
| 2006/0063459 | A1 | 3/2006 | Iba et al. | 445/3 |
| 2006/0087219 | A1 | 4/2006 | Taniguchi et al. | 313/495 |
| 2006/0091780 | A1 | 5/2006 | Minami | 313/495 |
| 2006/0164001 | A1 | 7/2006 | Iba et al. | 313/495 |

FOREIGN PATENT DOCUMENTS

| | | | |
|---|---|---|---|
| EP | 1100107 | * | 5/2001 |
| JP | 4-12436 | | 1/1992 |
| JP | 5-121012 | | 5/1993 |
| JP | 7-94076 | | 4/1995 |
| JP | 7-235257 | | 9/1995 |
| JP | 9-245689 | | 9/1997 |
| JP | 9-298030 | | 11/1997 |
| JP | 2000-133118 | | 5/2000 |
| JP | 200260325 | * | 9/2000 |
| JP | 2003-68235 A | | 3/2003 |
| JP | 2004127944 | * | 4/2004 |
| KR | 2003050573 | * | 6/2003 |

OTHER PUBLICATIONS

European Communication Pursuant to Article 94(3) EPC dated Apr. 15, 2009, regarding Application No. 05 023 077.0-2208.

Schulz, L., Sputter-Ion Pumps, Paul Scherrer Institut, Villigen, Switzerland, 6 sheets.

Vacuum Technology-Vocabularly-Part 1: General Terms, JIS Z 8126-1 (1999), 2 sheets.

Schulz, L., Sputter-Ion Pumps, Paul Scherrer Institut, Villigen, Switzerland (1999), 6 sheets.

* cited by examiner

IMAGE FORMING APPARATUS WITH REDUCED LOSS OF ELECTRON SOURCE CAUSED BY THE INERT GAS

BACKGROUND OF THE INVENTION

1. Field of the Invention

The present invention relates to an image forming apparatus displaying an image by radiating an electron beam emitted from an electron source to a phosphor film which is an image display member to make the phosphor of the phosphor film emit light.

2. Related Background Art

Conventionally, in an apparatus radiating an electron beam emitted from an electron source to a phosphor film which is an image display member to make the phosphor of the phosphor film emit light for displaying an image, it is necessary to maintain the inside of a vacuum chamber which involves the electron source and the image display member therein to be a high vacuum. The reason is that, in the case where a gas is generated in the vacuum chamber to raise the pressure therein, the rise of the pressure exerts a harmful influence on the electron source to reduce the electron emission quantity thereof, which makes it impossible to display a bright image, though the degree of the influence changes with the kind of the gas. Furthermore, in that case, there is the possibility that an electric discharge occurs in the inside to destroy the apparatus.

Generally, the vacuum chamber of an image display apparatus is formed by combining glass members and adhering joining portions with frit or the like. The maintenance of a pressure after the joining has been once completed is performed by a getter material installed in the vacuum chamber.

A tabular image forming apparatus generally has a narrow interval between a substrate on which electron sources are provided and the other substrate on which an image display unit is provided. Moreover, because supporting members for holding the vacuum chamber and the like are provided, the flow of gas is hindered, and the tabular image forming apparatus is in a state of being bad in conductance.

In order to solve the problem, a configuration in which a getter material was arranged in an image display region to absorb active gases among the generated gases was considered (see, for example, Japanese Patent Application Laid-Open No. H04-12436).

Moreover, in order to exhaust inert gases which were unable to be exhausted by the getter material, a configuration in which an ion pump was externally attached to the main body of a vacuum chamber of a thin plane display apparatus was also proposed (see, for example, Japanese Application Patent Laid-Open No. H05-121012).

Moreover, a configuration in which an electron source for ionizing an inert gas was provided out of the image display region in the panel, which place was called as a sacrifice region, and was used as an ion pump built in the panel was proposed (see, for example, U.S. Pat. No. 6,107,745).

Furthermore, in a general CRT, a cathode is arranged at a position which ions ionized by electron beams do not irradiate.

However, by the conventional technique disclosed in Japanese Patent Application Laid-Open No. H04-12436, the gases exhausted by the getter material are active gases, and inert gases such as Ar and He are hardly exhausted. Moreover, because, for example, Ar is heavy in weight among the inert gasses, there is a problem such that, in the case where Ar is accelerated by a strong electric field after ionization, the electron sources are damaged seriously.

Moreover, by the conventional technique disclosed in Japanese Patent Application Laid-Open No. H05-121012, there is some possibility that the external ion pump cannot deal with a rise of a local pressure of the inert gas in the tabular image display apparatus having deteriorated conductance. Moreover, because beams are deflected by the magnetic field used in the ion pump, some countermeasure such as magnetic shielding is necessary. Thus, the conventional technique also has a problem of a high cost.

Moreover, in the conventional technique disclosed in U.S. Pat. No. 6,107,745, because the electron source is provided out of the image display region, the tabular image display apparatus is influenced by the conductance, and there is some possibility that the tabular image display apparatus cannot deal with a local pressure rise. Moreover, because the arrangement of the ion pump is only out of the image region, and because the electron source for the ionization of the inert gas itself has a configuration having the possibility of being deteriorated, there is some possibility that a sufficient exhaust velocity and a sufficient total exhaust quantity cannot be obtained.

Moreover, it is difficult to apply the general CRT technique to a tabular image display apparatus.

SUMMARY OF THE INVENTION

It is an object of the present invention to provide an image display apparatus which can reduce the losses of electron sources caused by an inert gas existing in the panel and can exhaust the inert gas.

Moreover, it is another object of the invention to provide an image forming apparatus having a small aged deterioration and a small spatial distribution of luminance.

BRIEF DESCRIPTION OF THE DRAWINGS

FIG. 2A is a view showing a part thereof; and FIG. 2B is an enlarged view of a part A shown in FIG. 2A;

FIG. 3A is a view showing a part thereof; and FIG. 3B is an enlarged view of a part B shown in FIG. 3A;

FIG. 7A is a view showing a part thereof; and FIG. 7B is an enlarged view of a part C shown in FIG. 7A;

FIG. 8A is a view showing a part thereof; and FIG. 8B is an enlarged view of a part D shown in FIG. 8A;

FIG. 10A is a view showing a part thereof; and FIG. 10B is an enlarged view of a part E shown in FIG. 10A;

FIG. 11A is a view showing a part thereof; FIG. 11B is an enlarged view of a part F shown in FIG. 11A; and FIG. 11C is an enlarged view of a part G shown in FIG. 11A;

FIG. 12A is a view showing a part thereof; and FIG. 12B is an enlarged view of a part H shown in FIG. 12A;

FIG. 14A is a view showing a part thereof; and FIG. 14B is an enlarged view of a part I shown in FIG. 14A;

FIG. 17A is a view showing a surface thereof; and FIG. 17B is an enlarged view of a part J shown in FIG. 17A.

DETAILED DESCRIPTION OF THE PREFERRED EMBODIMENTS

The present invention is an image forming apparatus in which a first substrate provided with an electron-emitting device emitting electrons and a second substrate provided with an image displaying member irradiated with the electrons emitted from the electron-emitting device are arranged to be opposed to each other, and in which an image is displayed on the image displaying member by the electrons emitted from the electron-emitting device, the apparatus including: an electron source possessing deflecting means deflecting irradiation positions on the second substrate of the electrons emitted from the electron-emitting device; and inert gas trapping means for trapping an inert gas, the trapping means provided under or near the irradiation positions.

Because the present invention is configured as described above, the present invention can reduce the loss of the electron source caused by the inert gas existing in a panel, and also can exhaust the inert gas. Moreover, the present invention can reduce the aged deterioration and the spatial distribution of luminance.

Below, an embodiment of the present invention is described with reference to the attached drawings.

Figure 1:
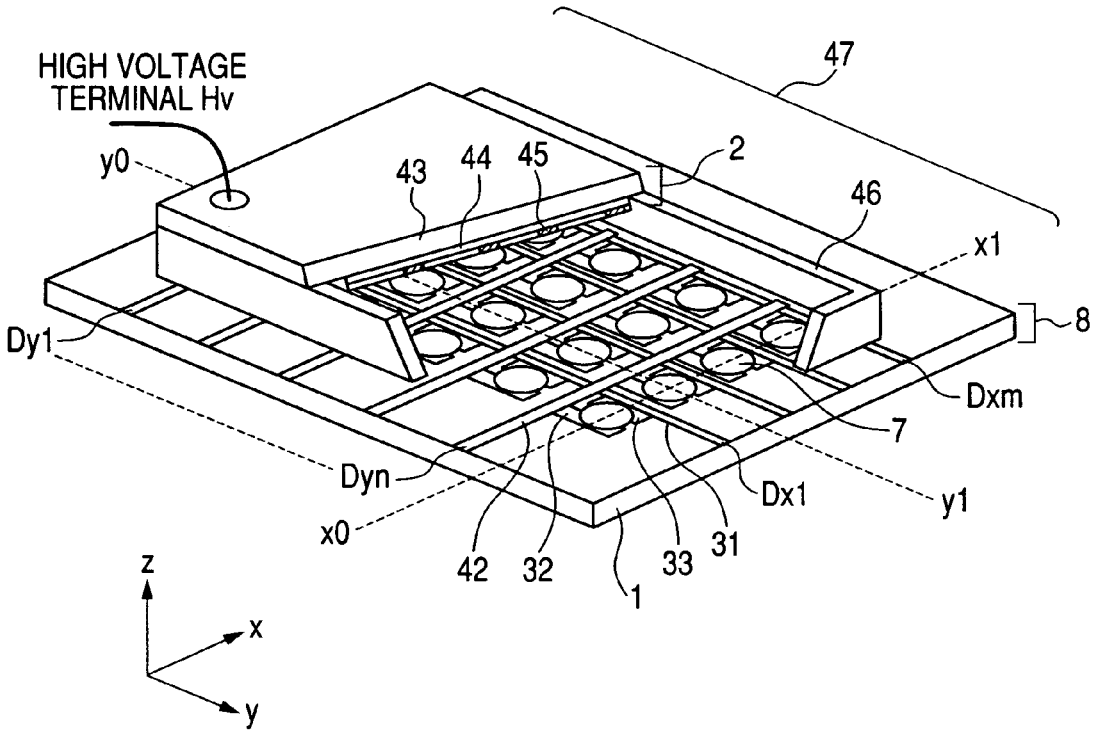
FIG. 1 is a perspective view showing the structure of an embodiment of an image forming apparatus of the present invention, and shows a state of being partially broken.

FIG. 1 is a perspective view showing the structure of an embodiment of an image forming apparatus of the present invention, and shows a state of being partially broken.

As shown in FIG. 1, in the present embodiment, a vacuum chamber 47 is configured in a form in which a rear plate 8, being a first substrate, and a face plate 2, being a second substrate, puts a supporting frame 46 between them. The rear plate 8 is provided with an electron source substrate 1, being an electron source; electron-emitting devices 7 emitting electrons from the electron source substrate 1; and electrically connecting terminals having an airtight structure for performing power supply from the outside of the vacuum chamber 47 to the electron-emitting devices 7. The electrically connecting terminals are denoted by reference marks Dx1-Dxm and Dy1-Dyn. Furthermore, the rear plate 8 is provided with column wiring 31 electrically connected to the electrically connecting terminals Dx1-Dxm and row wiring 42 electrically connected to the electrically connecting terminals Dy1-Dym. Furthermore, the rear plate 8 is provided with device electrodes (on the high voltage side) 33 connected with the column wiring 31 electrically and device electrodes (on the low voltage side) 32 connected to the row wiring 42 electrically. A voltage is applied to the device electrodes 33 through the column wiring 31, and a voltage is applied to the device electrodes 32 through the row wiring 42. The device electrodes 33 and 32 are configured in order that an electric field may be applied to the electron-emitting devices 7 from the outside of the vacuum chamber 47.

Moreover, the face plate 2 includes a glass substrate 43 and a metal back 45. The metal back 45 is arranged on the glass substrate 43, and is used as both of an electrode and an emitted-light reflecting thin film. The electron beams emitted from the electron-emitting devices 7 transmit the metal back 45. Furthermore, the face plate 2 includes a phosphor film 44, which is an image displaying member emitting light for displaying an image by being irradiated with electron beams transmitted the metal back 45, to which a high voltage is applied. Furthermore, the face plate 2 is provided with a high voltage terminal Hv, which is an electrically connecting terminal having an airtight structure for performing power supply to the metal back 45 from the outside of the vacuum chamber 47.

Next, a deflection mechanism of electron beams and an ion trapping mechanism, which are the feature portions of the present invention, are described.

Generally, in the case where the trajectory of an electron emitted by a drive of an electron source is straight to an opposed electrode, an inert gas such as Ar existing in the air collides with the emitted electron to be ionized. The ionized inert gas ion has a positive monovalent or multivalent charge, and is accelerated in the direction reverse to that of the electron by an electric field for accelerating the electron to collide with the substrate provided with the electron source located just under an inert gas ion generation part at high energy. That is, when an electron emitted from an electron source passes above the electron source or an adjoining electron source, an ionized and accelerated inert gas ion collides with an electron source located just below the inert gas ion generation part to damage the electron source.

Moreover, because the mass of the inert gas ion colliding with the electron source is heavier than the mass of an electron, the electron source deteriorates by the collision with the inert gas ion, and the electron quantity to be emitted diminishes.

Figure 2A:
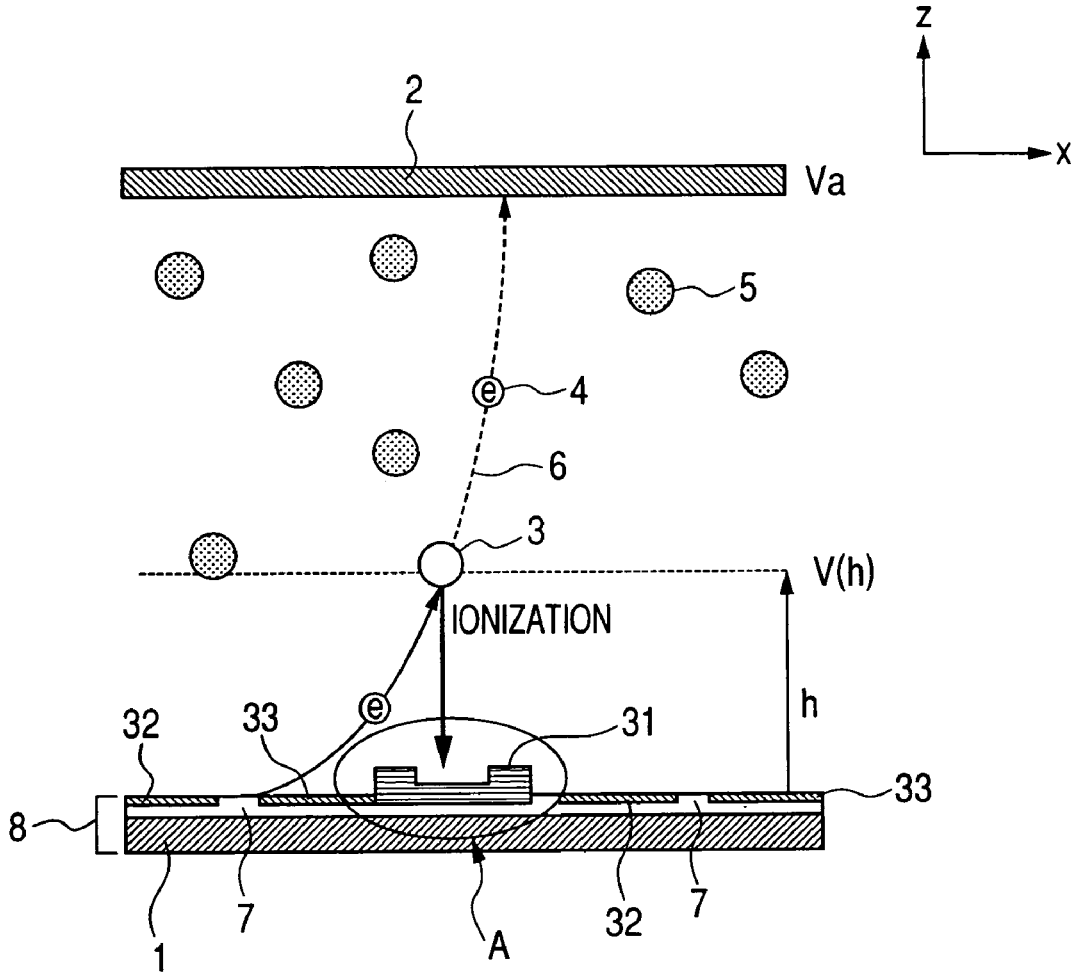
FIGS. 2A and 2B are views showing a cross section taken along line x0-x1 shown in FIG. 1.
Figure 2B:
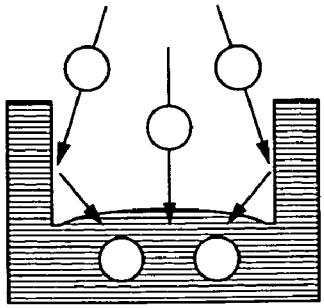
Figure 3A:
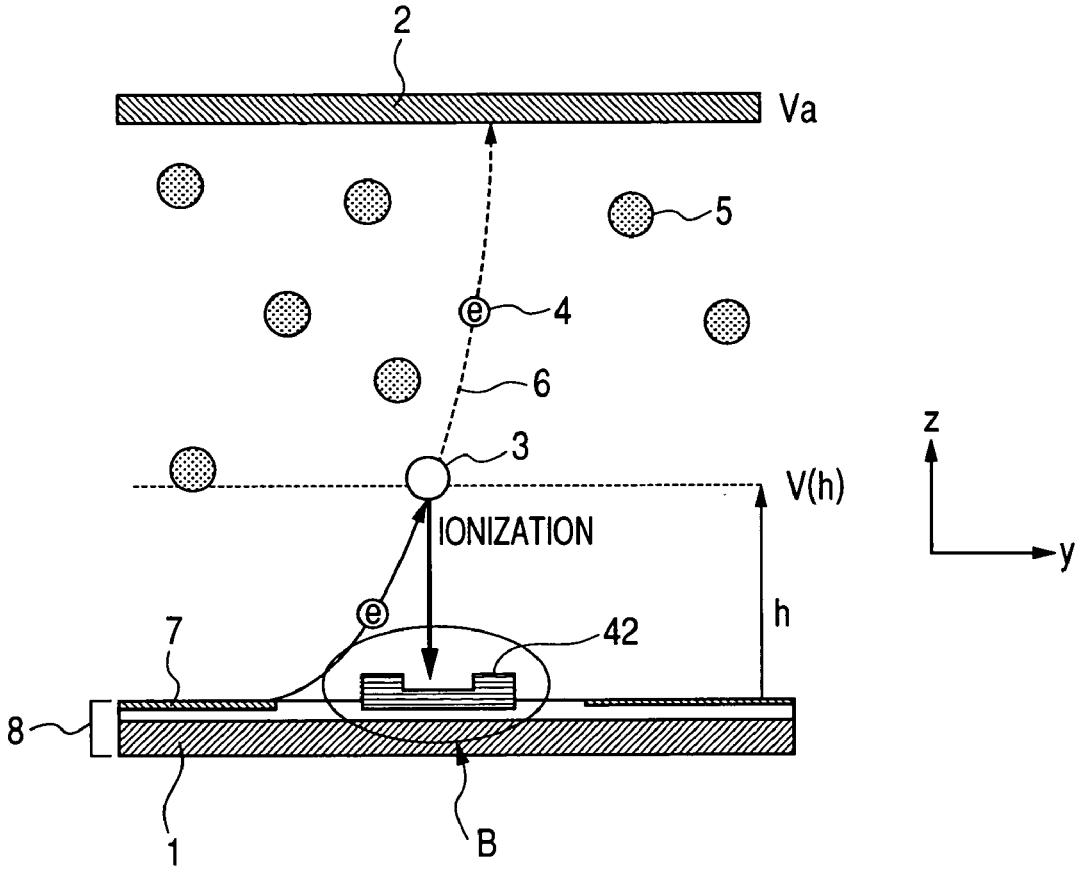
FIGS. 3A and 3B are views showing a cross section taken along line y0-y1 shown in FIG. 1.
Figure 3B:
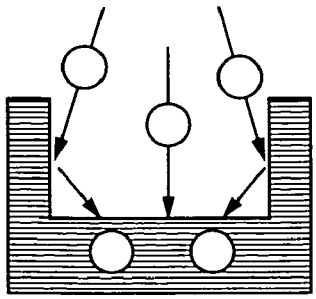

FIGS. 2A and 2B are views showing a cross section taken along line x0-x1 shown in FIG. 1; FIG. 2A is a view showing a part thereof; and FIG. 2B is an enlarged view of a part A shown in FIG. 2A. Moreover, FIGS. 3A and 3B are views showing a cross section taken along line y0-y1 shown in FIG. 1; FIG. 3A is a view showing a part thereof; and FIG. 3B is an enlarged view of a part B shown in FIG. 3A.

As shown in FIGS. 2A, 2B, 3A and 3B, an inert gas 5 exists between the face plate 2 and the rear plate 8. Moreover, by the electric potential distribution generated by the voltages applied to the device electrodes (on the lower voltage side) 32 and the device electrodes (on the higher voltage side) 33, which put the electron-emitting devices 7 between them, the column wiring 31, the row wiring 42 and the face plate 2, the electron orbit 6 of an electron 4 emitted from an electron-emitting device 7 crookedly progresses in the x direction and the y direction, and is spread in the z direction. That is, a device electrode (on the lower voltage side) 32 and a device electrode (on the higher voltage side) 33 constitute electric field applying means as an example of a deflecting means, and an electric field is applied between the face plate 2 and the rear plate 8. In this case, it is supposed that the column wiring 31 and the device electrode (on the higher voltage side) 33 are at the same potential. Thereby, the density of inert gas ions 3 poured on the electron-emitting device 7 is diminished. Incidentally, the column wiring 31 is configured to be higher in height to the face plate 2 side than those of the device electrode (on the lower voltage side) 32 and the device electrode (on the higher voltage side) 33.

Moreover, in the present embodiment, although the electron orbit 6 of the electron 4 is bent by applying the electric field between the face plate 2 and the rear plate 8, it is considerable to use a magnetic field.

In such a way, in the image forming apparatus of the present invention, the damage of the electron source by the collisions of the inert gas ions 3 is reduced by the deflection mechanism for preventing the electron orbit 6 from passing on the device and the adjacent devices.

Here, the energy of the emitted general electron 4 is described.

Figure 4:
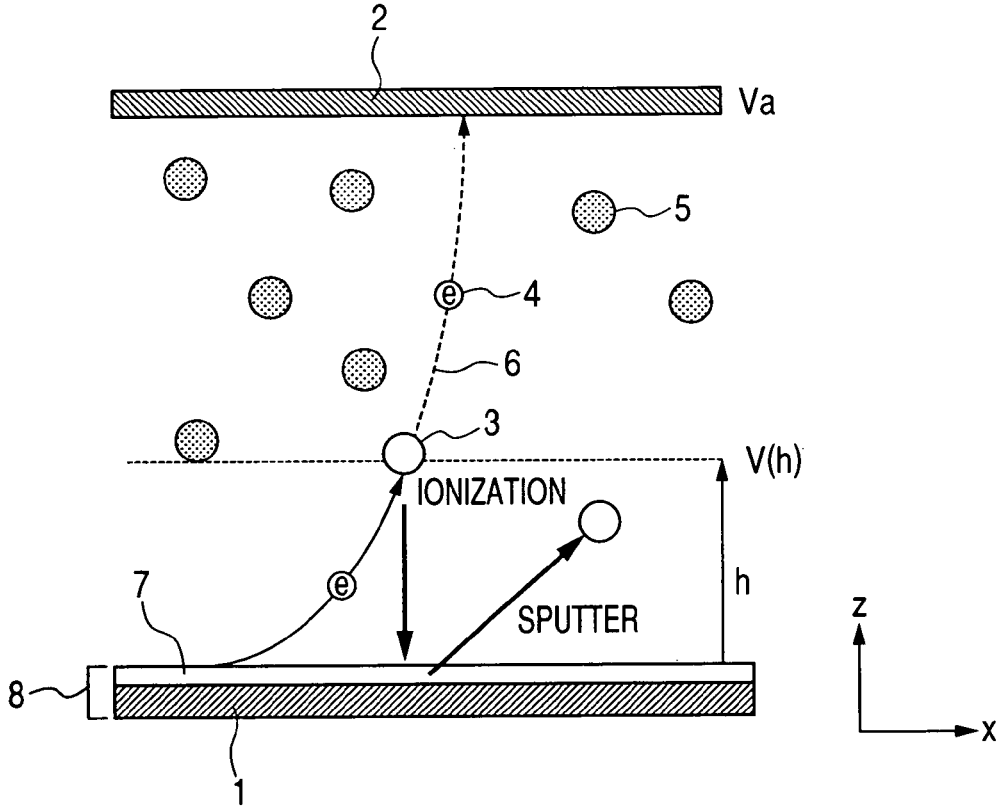
FIG. 4 is a view showing the electron orbit 6 of an electron 4 emitted from an electron source substrate 1 shown in FIG. 1.

FIG. 4 is a view showing the electron orbit 6 of the electron 4 emitted from the electron source substrate 1 shown in FIG. 1.

As shown in FIG. 4, the number of the inert gas ions 3 sputtering the neighborhood of an electron emitting region by shifting the electron orbit 6 of the electron 4 emitted from the electron source substrate 1 from the right above of the electron emitting region as the electron 4 goes toward the face plate 2. Thereby, the deterioration of the electron source substrate 1 can be suppressed.

In this case, the energy of the electron 4 at the time when the inert gas 5 is ionized is determined by a voltage V(h) obtained from an applied anode voltage and a height h where the inert gas 5 is ionized. Because the initial energy of the inert gas ions 3 after the ionization can be considered to be almost zero, the energy Eion of the inert gas ions 3 accelerated to the neighborhood of the electron source can be expressed as follows when the ionization value number is denoted by n:

$$Eion = neV(h).$$

Figure 5:
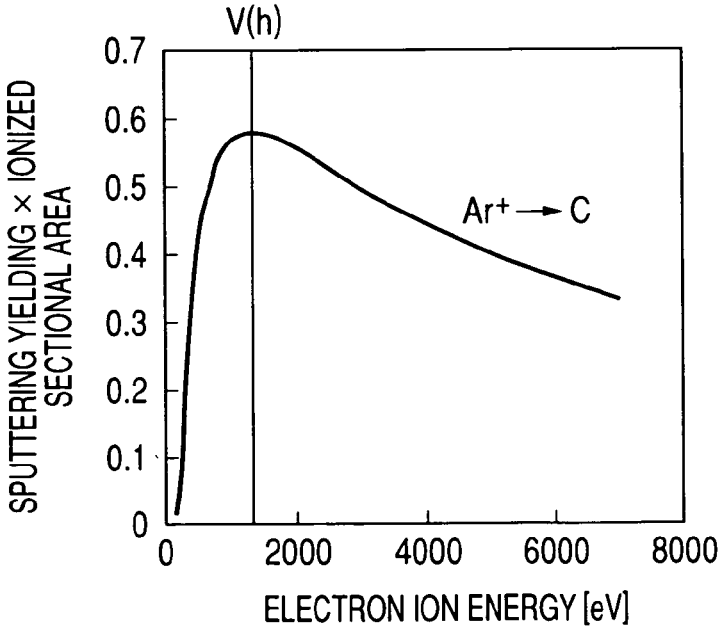
FIG. 5 is a view showing the energy dependency of ionized sectional area x sputtering yielding, which is used as an index of the deterioration of the electron source substrate 1 shown in FIGS. 1 and 4.

FIG. 5 is a view showing the energy dependency of ionized sectional area x sputtering yielding, which is used as an index of the deterioration of the electron source substrate 1 shown in FIGS. 1 and 4.

As shown in FIG. 5, for example, in the case where the inert gas 5 is Ar and the configuration member in the neighborhood of the electron source is carbon, n=1 is dominant. It is in the case where the energy at the time when Ar is ionized by the electron 4, which is the energy at the time when the carbon is sputtered by Ar ions, is 1 ekV that the amount of the carbon to be sputtered becomes the maximum. Accordingly, in view of the electron orbit 6, a mechanism in which the position just below at the time when the electron 4 is accelerated to 1 ekV becomes distant as far as possible is necessary.

Moreover, by providing the trapping mechanism of the inert gas ions 3 in the region in which the density of the inert gas ions 3 proceeding to the electron source substrate 1 side becomes high, the inert gas 5 in the panel can be reduced, and the deterioration of the electron source substrate 1 can be suppressed. The inert gas ions 3 collide with the trapping region at the high energy of several keV, and enter the inside of the trapping region until the inert gas ions 3 has lost their energy. In the case where the succeeding inert gas ions 3 continue to collide, there is the possibility that the inert gas ions 3 are re-emitted into the air.

In order to prevent the phenomenon, after the inert gas ions 3 have been driven in, it is effective to form a film on the surface thereof by sputtering or the like. The sputtering yielding has incident angle dependency of the inert gas ions 3. The smaller the incident angle is, the larger the sputtering yielding. Accordingly, by forming a recess in the ion trapping region, large sputtering efficiency can be obtained when the inert gas ions 3 collide with a sheer portion on a side face. Because the member of the trapping region is sputtered by the inert gas ions 3 which have collided with the side face to be deposited on the bottom face, the member has an effect of burying the inert gas ions 3 driven to the bottom face of the recess.

Furthermore, in the case where the trapping region surface is made of Ti, a clean surface of Ti appears by the sputtering of Ti, and active gases can be absorbed by the clean surface. Furthermore, because the recess is provided on the trapping region surface, the surface area thereof increases, and the life of a pump becomes longer. Moreover, because all of the electron-emitting devices 7 for an image display are used, a locally sufficient exhaust velocity can be obtained without any magnets.

Because the configuration shown in FIGS. 2A, 2B 3A and 3B is repeatedly arranged on the electron source substrate 1 as shown in FIG. 1, it is necessary to locate an electron orbit 6 of an electron-emitting device 7 at a position distant from the position right above the device, and to prevent the electron orbit 6 from passing the positions right above the adjacent devices. Moreover, the column wiring 31 and/or the row wiring 42, which are inert gas trapping means, are provided just below the positions where the energy of the emitted electrons 4 is near 1 keV. Furthermore, in order that the trapping of the inert gas ions 3 may be performed efficiently at the column wiring 31 and/or the row wiring 42, a recess is formed on the surface of the column wiring 31 and/or the row wiring 42. By these measures, the re-emission of the inert gas ions 3 is suppressed, and the partial pressures of the inert gas 5 in the vacuum chamber 47 are reduced.

Here, a plurality of recesses may be formed on the surfaces of the column wiring 31 and/or the row wiring 42. Moreover, the surfaces of the column wiring 31 and/or the row wiring 42 may be made of Ti, and consequently it becomes possible to exhaust active gases as well as the inert gas 5.

Moreover, the column wiring 31 and/or the row wiring 42 may be made of a material having an atomic weight of 100 or more, and consequently only charge exchanges of ions are performed at the time of collisions to perform the reflection effectively in the form of neutral particles, which are electrically neutral. Inert gases having been scattered elastically or inelastically perform uniform motions, and the inert gases collide with a wide region of the face plate 2 while keeping the energy near that at a collision at the maximum. At that time, Coulomb scattering is less, and the inert gases can invade to deep positions. Furthermore, because the recess is formed on the face plate 2 and the surface thereof is made of Ti, the same effect as that of the above-mentioned trapping effect in the rear plate 8 can be obtained. As a result, the possibility of re-emission of the previously embedded inert gas atoms becomes small, and the life as a pump becomes longer as well as the exhaust velocity is improved.

Moreover, the side face and the bottom face of the recess on the column wiring 31 and/or the row wiring 42 may be made of Ti, and the surfaces of the other part may be made of Ta.

Thereby, ions can be efficiently trapped on the side face and the bottom face, and the ions are reflected on the other parts to be able to be trapped on the face plate 2.

Moreover, a grid may be provided between the rear plate 8 and the face plate 2. Thereby, the collisions of the ions at the neighborhood of the electron emitting regions can be suppressed by providing an ion trapping mechanism on the grid, or by arranging a trap mechanism under the aperture portion of the grid.

Moreover, the electron source, the electron orbit deflection mechanism and the inert gas trapping mechanism of FIGS. 2A and 2B may be provided on the outside of the image display region, and the high voltage applied in the image display region may differ from the high voltage applied on the outside of the image display region. Thereby, the voltage suitable for ion trapping can be applied, and the trapping efficiency can be improved.

Next, referring to FIG. 1, a concrete example is shown, and the configuration of the image display panel to which the present invention is applied and the display method thereof are described.

In assembling the vacuum chamber 47 first, it is necessary to carry out seal bonding in order to maintain the sufficient intensity and the sufficient airtightness of the joining of each member. For example, by coating frit glass to the joining portion and by baking the joining portion at the temperature of from 400° C. to 500° C. for 10 minutes or longer in the air or in nitrogen atmosphere to achieve the seal bonding. The method of exhausting the inside of the vacuum chamber 47 to a vacuum will be described later.

Next, the electron source substrate 1 to be used for the image forming apparatus of the present invention is described.

The electron source substrate 1 used for the image forming apparatus of the present invention is configured by arranging a plurality of cold cathode devices on a substrate.

As a method of the arrangement of the cold cathode devices, for example, simple matrix wiring of connecting each of the row wiring 42 and the column wiring 31 of a pair of device electrodes in the cold cathode device can be cited. In some rear plates 8, there is a case where a substrate on which N×M of cold cathodes are formed is fixed (N and M are severally an integer of two or more, and are suitably set according to an aimed display pixel number. For example, in a display apparatus aiming at a display of a high definition television, it is desirable to set the numbers of N=3000 and M=1000 or more).

The N×M cold cathode devices is configured by performing the simple matrix wiring of N wires of the row wiring 42 and M wires of the column wiring 31. As a manufacturing method of the row wiring 42, the column wiring 31 and an interlayer insulation layer, the screen printing method and a method of exposing and developing a photosensitive thick film paste, and the like are generally known.

In the present embodiment, in order to form a recess in the column wiring 31, as shown in FIGS. 2A and 2B, after the forming of a rectangular electrode, electrodes are further laminated on both ends so that a recess may be formed in the center on the column wiring 31. A similar configuration may be formed on the row wiring 42 as shown in FIGS. 3A and 3B. Incidentally, other techniques may be used as the manufacturing method without being limited to the present embodiment.

Next, the manufacturing method is described.

On the electron source substrate 1 on which the device electrodes (on the lower voltage side) 32 and the device electrodes (on the higher voltage side) 33 had been already manufactured, a thick film photosensitive paste was coated on the whole surface to be a coated film thickness of 10 μm by the screen printing method. Next, a photomask of a predetermined pattern was aligned, and then the photomask was put on the electron source substrate 1 to perform an ultraviolet ray exposure under the condition of 300 mJ/cm$^2$. After that, the water development of the thick film photosensitive paste was performed, and the baking of the electron source substrate 1 was performed at 480° C. for 10 minutes to obtain the column wiring 31 having a rectangular cross section. Moreover, by printing, mask alignment, ultraviolet exposure, development and baking, lamination was performed in order that the column wiring 31 might have a concave cross section having a recess at the center as shown in FIGS. 2A and 2B. The column wiring 31 was formed to have a height of 25 μm and the depth of the recess of 15 μm. The widths and the height of the column wiring 31 are not limited to those in the present example, but they are suitably set according to the initial velocity vector of an electron beam, the voltage applied to the face plate 2, the distance between the face plate 2 and the rear plate 8, and the like. Moreover, a preferable range of the depth of the recess is that of from several μm to several tens μm. As for an insulation layer, a thick film photosensitive insulation paste was coated on the whole surface to be a thickness of 20 μm by the screen printing, and was exposed with a photomask. After that, water development thereof and the baking thereof were performed. The conditions of the exposure and the baking were the same as those of the column wiring 31, and such a process was repeated several times.

Finally, the row wiring 42 was made of a photosensitive silver paste to have a coated film thickness of 10 μm by the screen printing on the whole surface, and a photomask of a predetermined pattern was aligned to be put on the photosensitive silver paste. Then, an ultraviolet ray exposure was performed under the condition of 300 mJ/cm$^2$. After that, water development was performed, and baking at 480° C. was performed for ten minutes to obtain the pattern of the row wiring 42. Furthermore, by printing, mask alignment, ultraviolet ray exposure, development and baking, laminating was carried out in order that the row wiring 42 might have a concave cross section form having a recess in the center as shown in FIGS. 3A and 3B.

Next, the structure of a multi-electron beam source in which the simple matrix wiring of the surface conduction electron-emitting devices 7 is formed on the substrate as the cold cathode devices is described.

Figure 6:
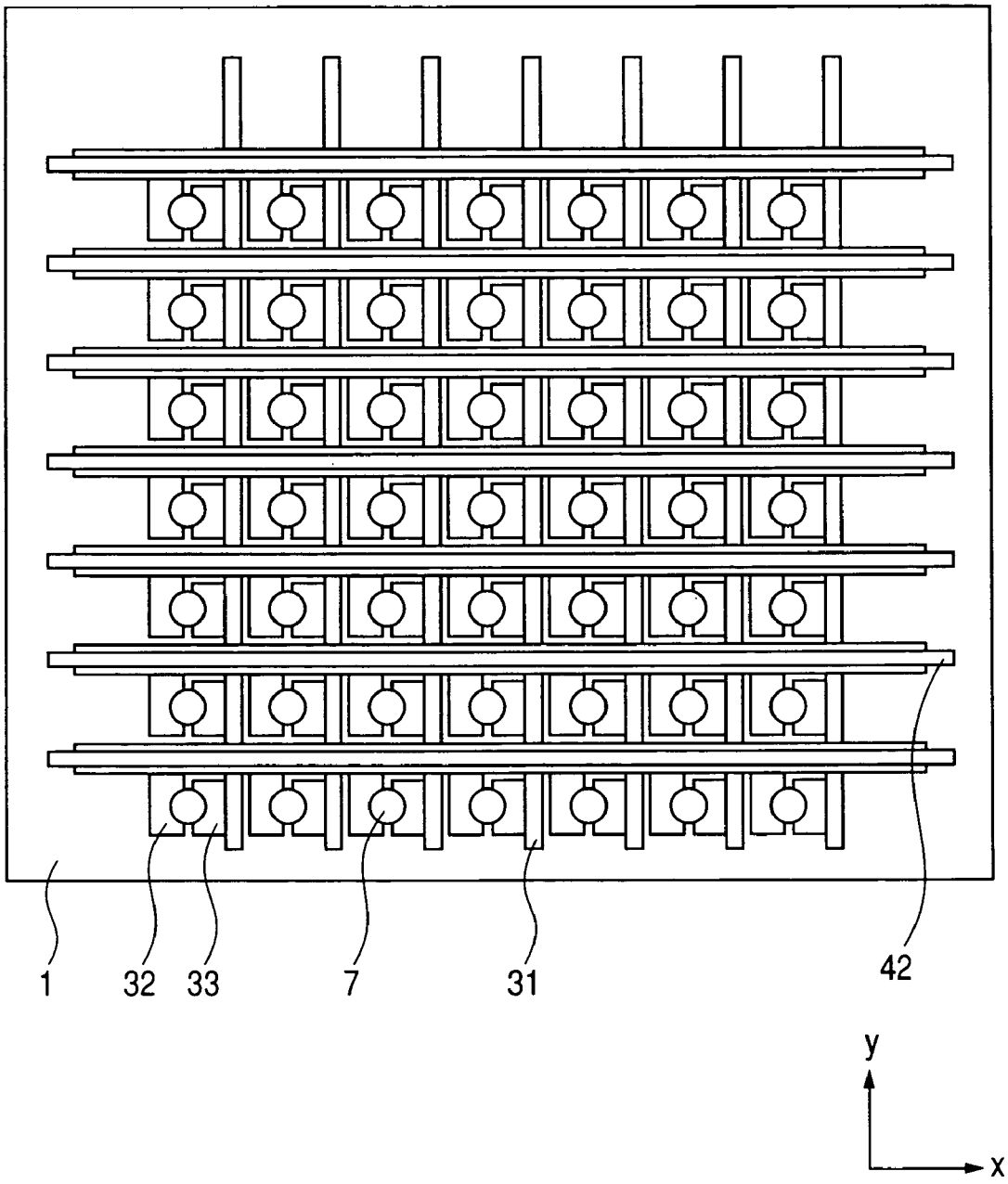
FIG. 6 is a plan view of the electron source substrate 1 of a multi-electron beam source used in the image forming apparatus shown in FIG. 1.

FIG. 6 is a plan view showing the electron source substrate 1 of a multi-electron beam source used in the image forming apparatus shown in FIG. 1.

On the electron source substrate 1, a plurality of devices is wired by the row wiring 42 and the column wiring 31 in the shape of a simple matrix. An insulating layer is formed between electrodes and electric insulation is maintained at the portions at which the row wiring 42 and the column wiring 31 intersect with each other.

Incidentally, in the multi-electron source of such a structure, the row wiring 42, the column wiring 31, the insulating layers between electrodes, the device electrodes (on the lower voltage side) 32, the device electrodes (on the higher voltage side) 33 and the electroconductive thin films of the surface conduction electron-emitting devices 7 are beforehand formed on a substrate. After that, an energization forming operation and an energization activation operation are performed by supplying electric power to each device through the row wiring 42 and the column wiring 31, and consequently the multi-electron source is manufactured.

Moreover, the phosphor film 44 is formed on the undersurface of the face plate 2 shown in FIG. 1. Furthermore, the metal back 45 is formed on the surface on the side of the rear plate 8 of the phosphor film 44. The metal back 45 is formed by performing the smoothing processing of the surface of the phosphor film 44 after forming the phosphor film 44 on the face plate 2, and then by performing the vacuum evaporation of Al on the smoothed surface of the phosphor film 44.

Next, an example of the method of making the inside of the vacuum chamber 47 a vacuum is described.

For exhausting the gas in order to make the inside of the vacuum chamber 47 a vacuum, an exhaust pipe and a vacuum pump are connect to the vacuum chamber 47 after assembling the vacuum chamber 47 to exhaust the inside of the vacuum chamber 47. After that, an exhaust pipe is sealed, and a getter film is formed at a predetermined position in the vacuum chamber 47 immediately before or immediately after the sealing in order to maintain the degree of vacuum in the inside of the vacuum chamber 47. The getter film is a film formed by heating a getter material containing, for example, Ba as the principal component with a heater or with high frequency heating to evaporate the getter material. By the absorption operation of the getter film, the degree of vacuum of the inside of the vacuum chamber 47 is maintained.

When a voltage is applied to each of the electron-emitting devices 7 through the electrically connecting terminals Dx1 or Dy1, electrons 4 are emitted from each of the electron-emitting devices 7. At the same time, a high voltage of from several hundreds V to several kV is applied to the metal back 45, and the emitted electrons 4 are accelerated by the high voltage to collide with the inner surface of the face plate 2. Thereby, the phosphor of the phosphor film 44 is excited to emit light, and an image is displayed. Ordinarily, the application voltage to the surface conduction electron-emitting device 7 is within a range of from about 12V to 18V, and voltage between the metal back 45 and the electron-emitting devices 7 is within a range of about 0.1 kV to 10 kV.

In the following, the examples of the image forming apparatus shown in the embodiment described above are exemplified to be described in detail. Incidentally, the present invention is not limited to these examples. In the examples to be described below, as a multi-electron beam source, one in which N×M (N=3,072, M=1,024) surface conduction devices of the above-mentioned type of including electron emission units in the conductive fine particle films between the electrodes are wired in a matrix (see FIG. 1) using N wires of the row wiring 42 and M wires of the column wiring 31 is used.

EXAMPLES

Example 1

The present example was manufactured based on the embodiment shown in FIG. 1, and an enlarged view of the cross section along the line x0-x1 is shown in FIGS. 2A and 2B.

The electron beam deflection mechanism and the ion trapping mechanism of the present example are described. The column wiring 31 manufactured based on the present example was set to have a height of 25 μm and the depth of a recess of 15 μm. The width and the height of the column wiring 31 are suitably defined according to the initial velocity vectors of the electron beams, the voltage applied to the face plate 2, the distance between the face plate 2 and the rear plate 8, and the like without being limited to those of the present example. Moreover, the desirable range of recess is that of from several μm to several tens μm. After the manufacture, the voltages 0 V, 15.5 V and 10 kV were applied to the device electrodes (on the lower voltage side) 32 through the row wiring 42, the device electrodes (on the higher voltage side) 33 through the column wiring 31, and the high voltage terminal Hv, respectively. Thereby, as shown in FIGS. 2A and 2B, the electron orbit 6 was settled on the column wiring 31 at any heights h without passing the position above the adjacent device.

Thereby, the electron-emitting devices 7 hardly received damages by the ionized inert gas ions 3. Moreover, many of the ionized inert gas ions 3 collided with the column wiring 31, and penetrated the inside of the column wiring 31. The inert gas ions 3 having collided with the side face of the recess of the column wiring 31 were made to have higher sputter effect of beating and driving out the material of the surface of the column wiring 31, and the material to be sputtered was deposited on the bottom face. Thereby the re-emission of the inert gas ions 3 from the bottom face can be prevented.

By such an electron beam deflection mechanism and an ion trapping mechanism, the deterioration of the electron-emitting devices 7 is suppressed, and the image display apparatus of a long life can be obtained.

Incidentally, although only the column wiring 31 has been described in the present example, the same method of thinking can be applied to the row wiring 42.

Example 2

Figure 7A:
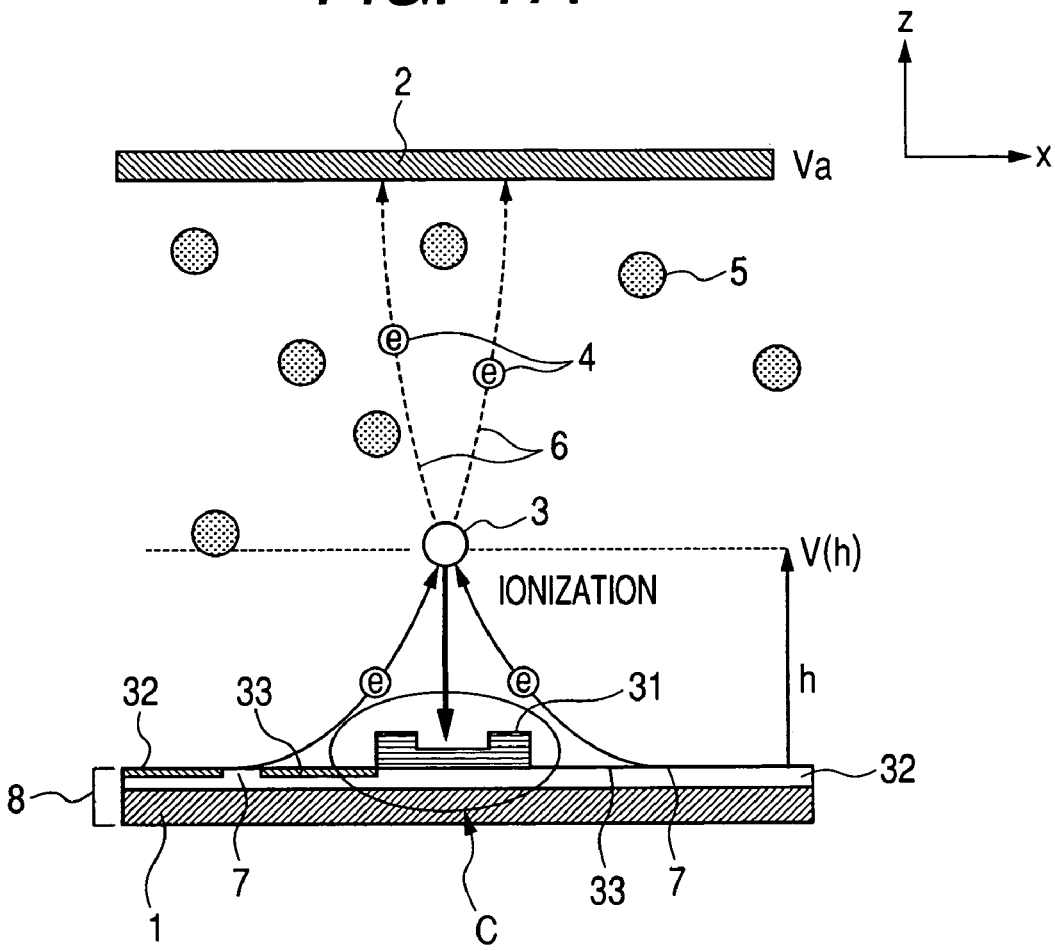
FIGS. 7A and 7B are views showing a cross section of a second example of the image forming apparatus shown in FIG. 1.
Figure 7B:
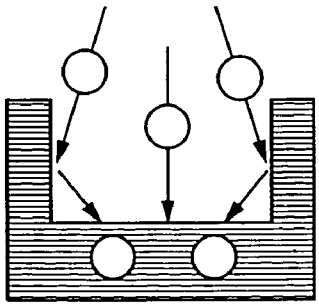

FIGS. 7A and 7B are views showing a cross section of a second example of the image forming apparatus shown in FIG. 1; FIG. 7A is a view showing a part thereof; and FIG. 7B is an enlarged view of a part C shown in FIG. 7A.

The present example forms one pixel of two electron-emitting devices 7 which put the column wiring 31 between them, as shown in FIGS. 7A and 7B. For this reason, both of the two device electrodes (on the higher voltage side) 33 putting the column wiring 31 between them are electrically connected to the column wiring 31, and a higher voltage is applied to the two device electrodes 33 than a voltage applied to the device electrodes (on the lower voltage side) 32 electrically connected to the row wiring 31 shown in FIG. 1. Only the above point differs from the first example. As a result, as shown in FIGS. 7A and 7B, two electron orbits 6 cross and pass above the column wiring 31. One pixel is formed by these two electron orbits 6.

The electron beam deflection mechanism and the ion trapping mechanism of the present example are described.

The column wiring 31 manufactured based on the present example was set to have a height of 25 μm and the depth of a recess of 15 μm. The width and the height of the column wiring 31 are suitably defined according to the initial velocity vectors of electron beams, a voltage applied to the face plate 2, the distance between the face plate 2 and the rear plate 8, and the like without being limited to the present example. Moreover, a desirable range of the recess is that of from several μm to several tens μm. After the manufacture, the voltages 0 V, 15.5 V and 10 kV were applied to the device electrodes (on the lower voltage side) 32 through the row wiring 42 shown in FIG. 1, the device electrodes (on the higher voltage side) 33 through the column wiring 31, and the high voltage terminal Hv shown in FIG. 1, respectively. Thereby, as shown in FIGS. 7A and 7B, the electron orbits 6 were settled on the column wiring 31 at any heights h without passing the positions above the adjacent devices.

Thereby, the electron-emitting devices 7 and the adjacent devices putting the column wiring between them hardly received the damages by the ionized inert gas ions 3. Moreover, many of the ionized inert gas ions 3 collided with the column wiring 31, and penetrated the inside of the column wiring 31. The inert gas ions 3 having collided with the side face of the recess of the column wiring 31 were made to have higher sputter effect of beating and driving out the material of the surface of the column wiring 31, and the material to be sputtered was deposited on the bottom face. Thereby the re-emission of the inert gas ions 3 from the bottom face can be prevented.

By such an electron beam deflection mechanism and an ion trapping mechanism, the deterioration of the electron-emitting devices 7 is suppressed, and the image display apparatus of a long life can be obtained. Moreover, in addition to the effects of the first example, because one pixel is composed of two devices, an image display apparatus having a further longer life can be obtained.

Incidentally, although only the column wiring 31 has been described in the present example, the same method of thinking can be applied to the row wiring 42.

Example 3

Figure 8A:
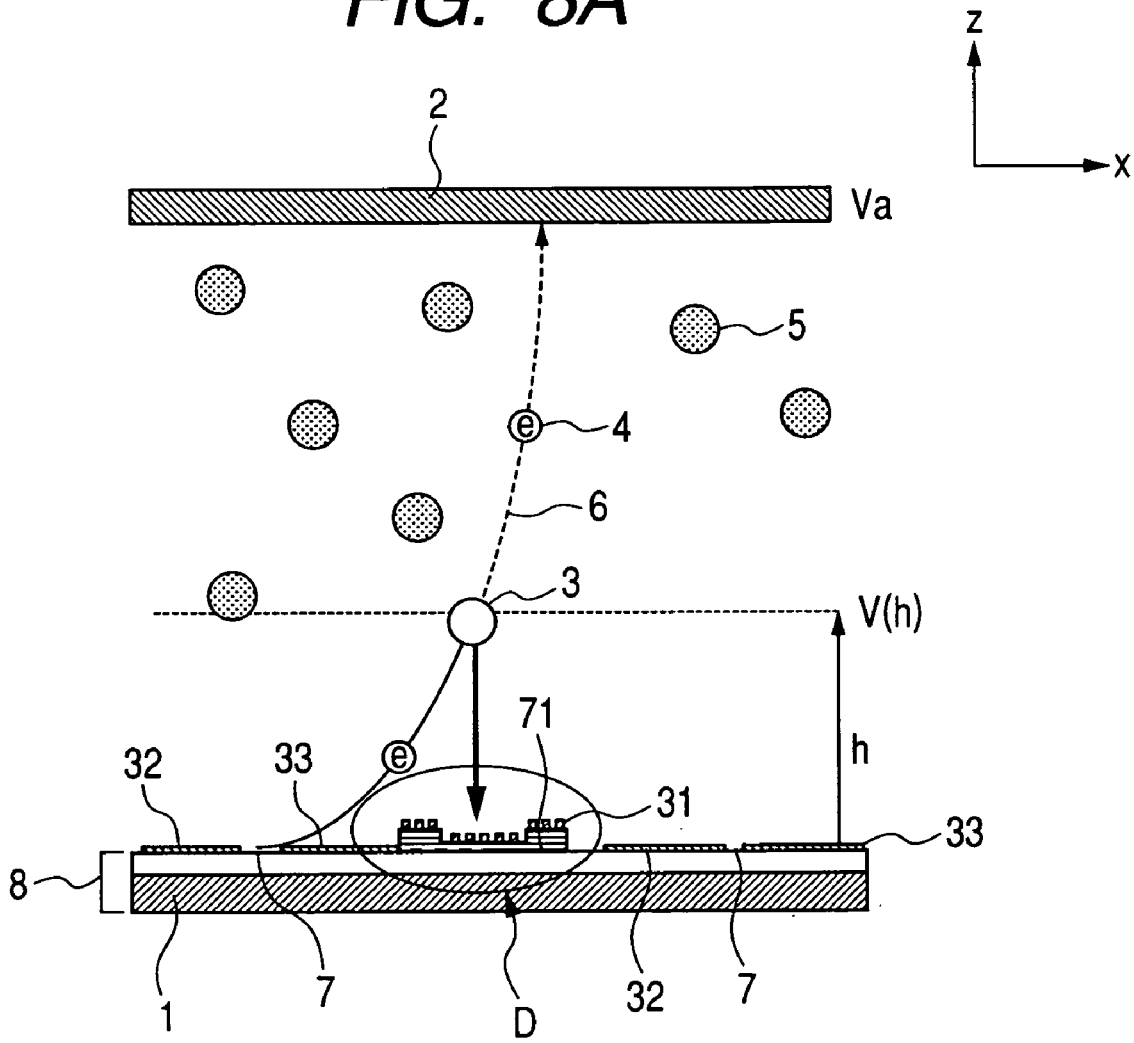
FIGS. 8A and 8B are views showing a cross section of a third example of the image forming apparatus shown in FIG. 1.
Figure 8B:
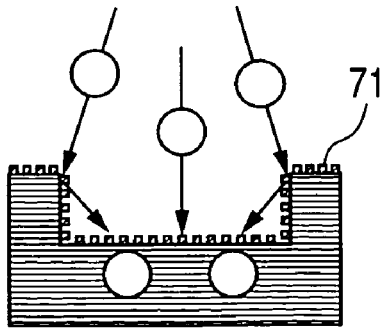

FIGS. 8A and 8B are views showing a cross section of a third example of the image forming apparatus shown in FIG. 1; FIG. 8A is a view showing a part thereof; and FIG. 8B is an enlarged view of a part D shown in FIG. 8A.

As shown in FIGS. 8A and 8B, the present example differs from the first example only in that the surface of the column wiring 31 is made of Ti 71.

The electron beam deflection mechanism and the ion trapping mechanism of the present example are described.

The column wiring 31 manufactured based on the present example was set to have a height of 25 μm and the depth of the recess of 15 μm. The width and the height of the column wiring 31 are suitably defined according to the initial velocity vectors of electron beams, a voltage applied to the face plate 2, the distance between the face plate 2 and the rear plate 8, and the like without being limited to the present example. Moreover, a desirable range of the recess is that of from several μm to several tens μm. Furthermore, a suitable mask was put on, and Ti 71 was formed as a film of about 1 μm in thickness on the column wiring 31. After the manufacture, the voltages 0 V, 15.5 V and 10 kV were applied to the device electrodes (on the lower voltage side) 32 through the row wiring 42 shown in FIG. 1, the device electrodes (on the higher voltage side) 33 through the column wiring 31, and the high voltage terminal Hv shown in FIG. 1, respectively. Thereby, as shown in FIGS. 8A and 8B, the electron orbit 6 was settled on the column wiring 31 at any heights h without passing the position above the adjacent device.

Thereby, the electron-emitting devices 7 hardly received the damages by the ionized inert gas ions 3. Moreover, many of the ionized inert gas ions 3 collided with the column wiring 31, and penetrated the inside of the column wiring 31. The inert gas ions 3 having collided with the side face of the recess of the column wiring 31 were made to have higher sputter effect of beating and driving out the material of the surface of the column wiring 31, and the material to be sputtered was deposited on the bottom face. Thereby the re-emission of the inert gas ions 3 from the bottom face can be prevented.

At the same time, active gases were absorbed by the sputtered Ti 71, and it was possible to perform the exhaust of the active gases as well as the inter gas 5.

By such an electron beam deflection mechanism and an ion trapping mechanism, the deterioration of the electron-emitting devices 7 is suppressed, and the image display apparatus of a long life can be obtained. Moreover, in addition to the effects of the first example, because the exhaust of the active gases is also performed, an image display apparatus having a further longer life can be obtained.

Incidentally, although only the column wiring 31 has been described in the present example, the same method of thinking can be applied to the row wiring 42.

Example 4

Figure 9:
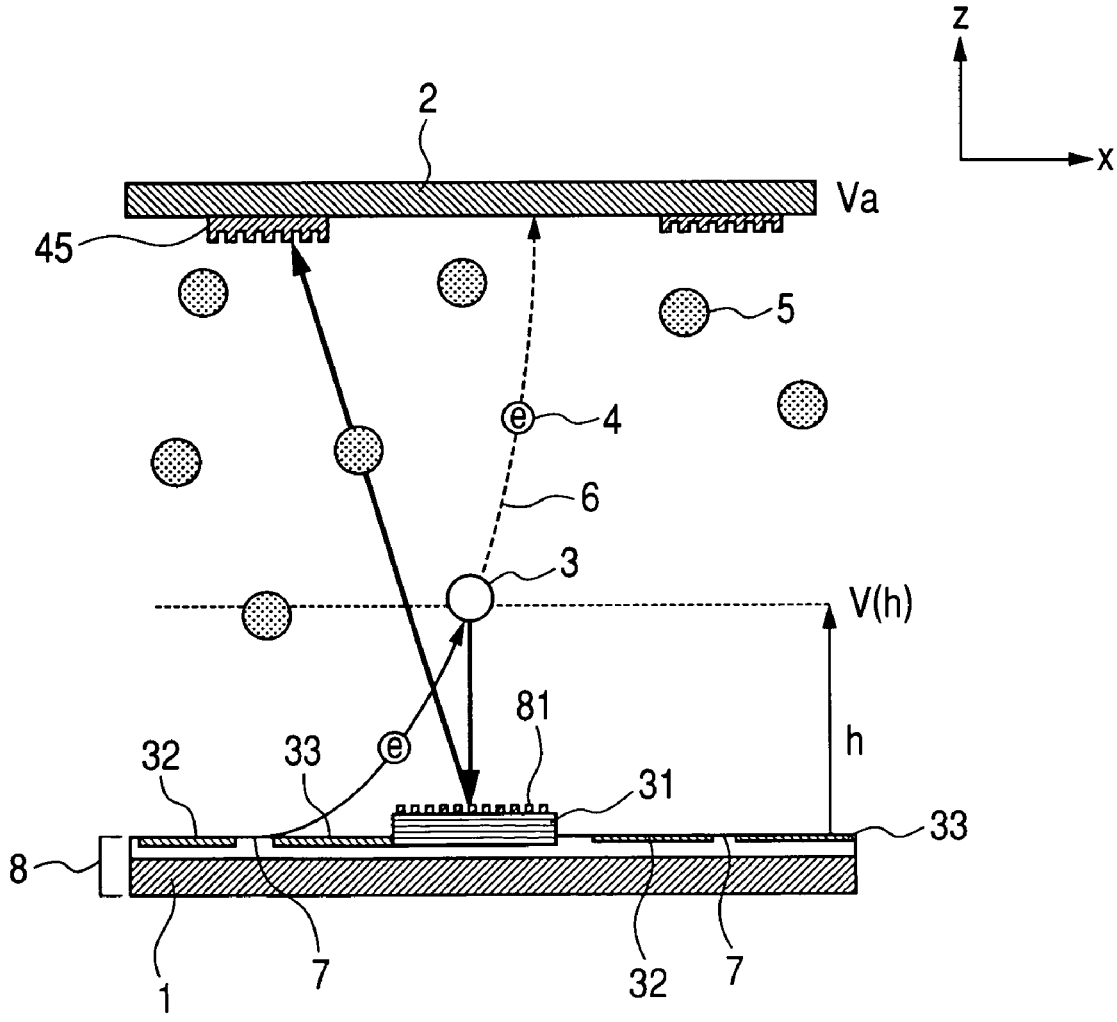
FIG. 9 is a view showing a part of a cross section of a fourth example of the image forming apparatus shown in FIG. 1.

FIG. 9 is a view showing a part of a cross section of a fourth example of the image forming apparatus shown in FIG. 1.

The present example was formed in order that the surface of the column wiring 31 might be flat, and was made of Ta 81 as a material having an atomic weight of 100 or more, which had large ion reflectance, as shown in FIG. 9. Moreover, a recess was formed in the neighborhood of an irradiation position of the electron 4, which was used as an inert gas trapping region on the face plate 2. The example differs from the first example only in the above points.

The electron beam deflection mechanism and the ion trapping mechanism of the present example are described.

The column wiring 31 manufactured based on the present example was set to have a height of 25 μm. The width and the height of the column wiring 31 are suitably defined according to the initial velocity vectors of electron beams, a voltage applied to the face plate 2, the distance between the face plate 2 and the rear plate 8, and the like without being limited to the present example. The material of the column wiring 31 of the present example was Cu. Furthermore, a suitable mask was put on it, and a film of Ta 81 was formed to be 1 μm in thickness on the column wiring 31 by sputtering. On the other hand, after the manufacture of the face plate 2, Al was evaporated on the phosphor film 44 as the metal back 45. After that, using a mask in the shape of a stripe, Al was further evaporated so as to be formed to have a cross sectional shape shown in FIG. 9. A preferable range of a recess is that of from several μm to several tens μm. After the manufacture of the display panel, the voltages 0 V, 15.5 V and 10 kV were applied to the device electrodes (on the lower voltage side) 32 through the row wiring 42 shown in FIG. 1, the device electrodes (on the higher voltage side) 33 through the column wiring 31, and the high voltage terminal Hv shown in FIG. 1, respectively. Thereby, as shown in FIG. 9, the electron orbit 6 was settled on the column wiring 31 at any heights h without passing the position above the adjacent device.

Thereby, the electron-emitting devices 7 hardly received the damages by the ionized inert gas ions 3. Moreover, many of the ionized inert gas ions 3 collided with the column wiring 31. However, because the surface of the column wiring 31 was made of Ta 81 having an atomic weight being nearly three times as large as that of Cu, which is the wiring material, the ratio of the ions reflected onto the side of the opposed face plate 2 as a neutral gas became large. Moreover, the reflection directions direct to the parts other than the regions right above the column wiring 31 because the reflection was diffusion reflection. The inert gas 5 having flown onto the face plate 2 penetrated the surface of the face plate 2. Although there is a case where another inert gas 5 had flown on the penetrated surface, the inert gas 5 was diffusedly reflected on the column wiring 31. Consequently, the density of the penetrated inert gas 5 became smaller than that of the inert gas ions 3 colliding with the column wiring 31, and the possibility of re-emission was small. Moreover, the inert gas 5 having flown onto the metal back 45 penetrated the bottom face of the recess. The material of the surface of the metal back 45 was sputtered by the inter gas 5 colliding with the side face, and the sputtered material was deposited on the bottom face. Thereby, the re-emission of the inert gas 5 from the bottom face was prevented.

By such an electron beam deflection mechanism and an ion trapping mechanism, the deterioration of the electron-emitting devices 7 is suppressed, and the image display apparatus of a long life can be obtained. In addition to the effects of the first example, because the inert gas 5 is embedded in a wide region, the life of the ion trapping effect becomes longer, and an image display apparatus having a further longer life can be obtained.

Incidentally, although only the column wiring 31 has been described in the present example, the same method of thinking can be applied to the row wiring 42.

Example 5

Figure 10A:
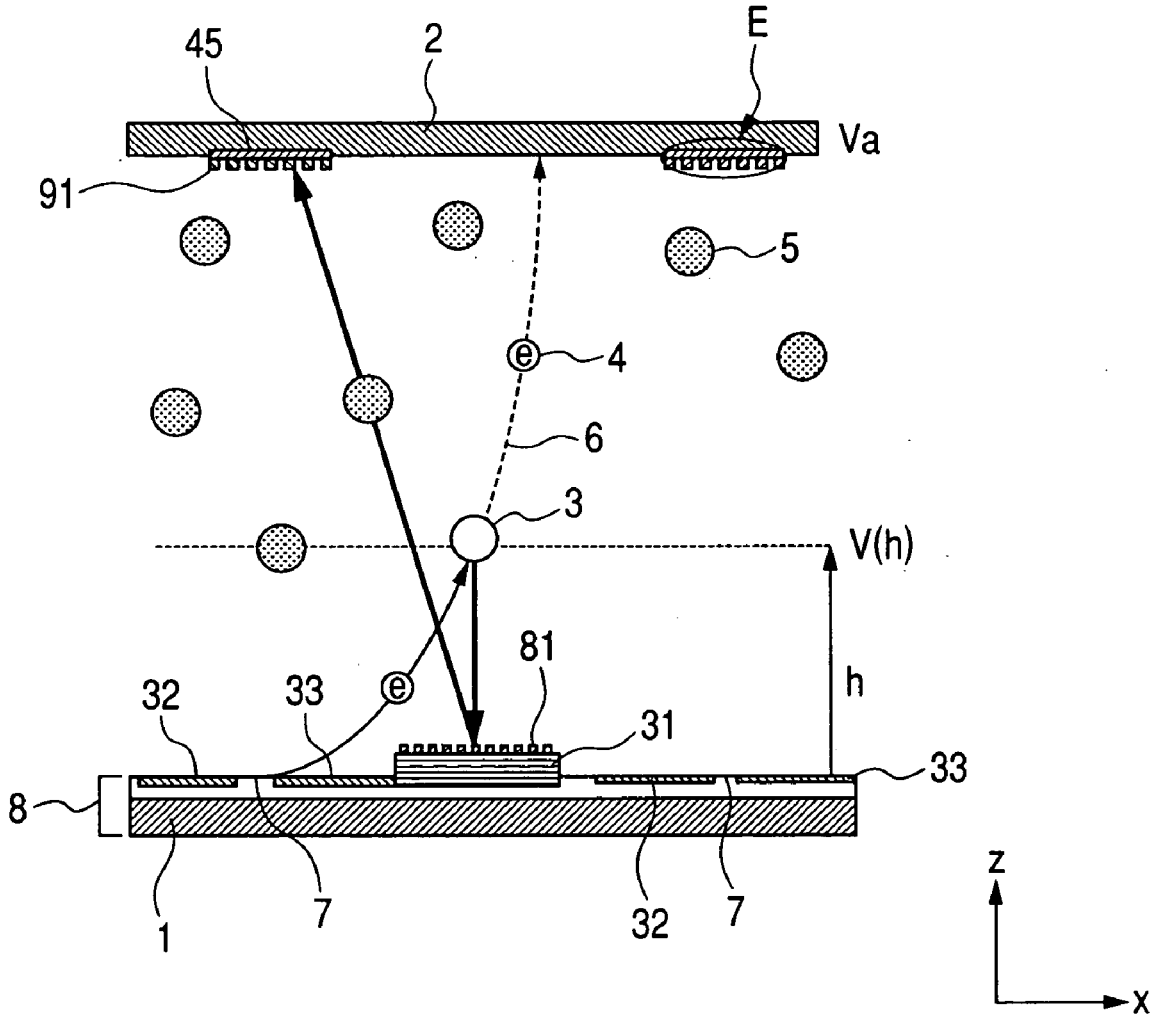
FIGS. 10A and 10B are views showing a cross section of a fifth example of the image forming apparatus shown in FIG. 1.
Figure 10B:
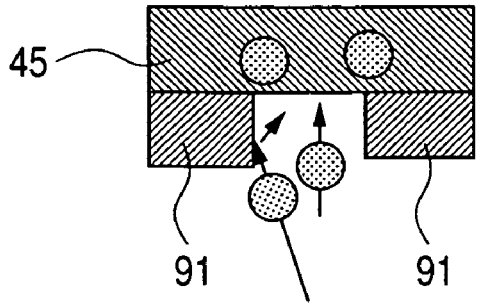

FIGS. 10A and 10B are views showing a cross section of a fifth example of the image forming apparatus shown in FIG. 1; FIG. 10A is a view showing a part thereof; and FIG. 10B is an enlarged view of a part E shown in FIG. 10A.

As shown in FIGS. 10A and 10B, the present example differs from the fourth example only in that the recessed surface formed on the face plate 2 was made of Ti 91.

The electron beam deflection mechanism and the ion trapping mechanism of the present example are described. The column wiring 31 manufactured based on the present example was set to have a height of 25 μm. The width and the height of the column wiring 31 are suitably defined according to the initial velocity vectors of electron beams, a voltage applied to the face plate 2, the distance between the face plate 2 and the rear plate 8, and the like without being limited to the present example. Moreover, the preferable range of the recess was within that of from several μm to several tens μm. Furthermore, a suitable mask was put on, and a film of Ta 81 was formed to be 1 μm in thickness on the column wiring 31 by sputtering. On the other hand, after the manufacture of the face plate 2, Al was evaporated on the phosphor film 44 as the metal back 45. After that, using a mask in the shape of a stripe, Al was further evaporated so as to be formed to have a cross sectional shape shown in FIGS. 10A and 10B. A preferable range of the recess is that of from several μm to several tens μm. After that, further using a mask in the shape of a stripe, Ti 91 was evaporated as shown in FIGS. 10A and 10B. After the manufacture of the display panel, the voltages 0 V, 15.5 V and 10 kV were applied to the device electrodes (on the lower voltage side) 32 through the row wiring 42 shown in FIG. 1, the device electrodes (on the higher voltage side) 33 through the column wiring 31, and the high voltage terminal Hv shown in FIG. 1, respectively. Thereby, as shown in FIGS. 10A and 10B, the electron orbit 6 was settled on the column wiring 31 at any heights h without passing the position above the adjacent device.

Thereby, the electron-emitting devices 7 hardly received the damages by the ionized inert gas ions 3. Moreover, many of the ionized inert gas ions 3 collided with the column wiring 31. However, because the surface of the column wiring 31 was made of Ta 81 having an atomic weight being nearly three times as large as that of Cu, which is the wiring material, the ratio of the ions reflected onto the side of the opposed face plate 2 as a neutral gas became large. Moreover, the reflection directions direct to the parts other than the regions right above the column wiring 31 because the reflection was diffusion reflection. The inert gas 5 having flown onto the face plate 2 penetrated the surface of the face plate 2. Although there is a case where another inert gas 5 had flown on the penetrated surface, the inert gas 5 was diffusedly reflected on the column wiring 31. Consequently, the density of the penetrated inert gas 5 became smaller than that of the inert gas ions 3 colliding with the column wiring 31, and the possibility of re-emission was small. Moreover, the inert gas 5 having flown onto the metal back 45 penetrated the bottom face of the recess. By the inert gas 5 colliding with the side face, Ti 91 of the surface thereof was sputtered to be deposited on the bottom face. Thereby, the re-emission of the inert gas 5 from the bottom face was prevented. At the same time, active gases were absorbed by the sputtered Ti 91, and also the exhaust of the active gases was able to be performed besides the exhaust of the inert gas 5.

By such an electron beam deflection mechanism and an ion trapping mechanism, the deterioration of the electron-emitting devices 7 is suppressed, and the image display apparatus of a long life can be obtained. In addition to the effects of the fourth example, because the exhaust of the active gasses is also performed, the life of the image display apparatus becomes further longer.

Incidentally, although only the column wiring 31 has been described in the present example, the same method of thinking can be applied to the row wiring 42.

Example 6

Figure 11A:
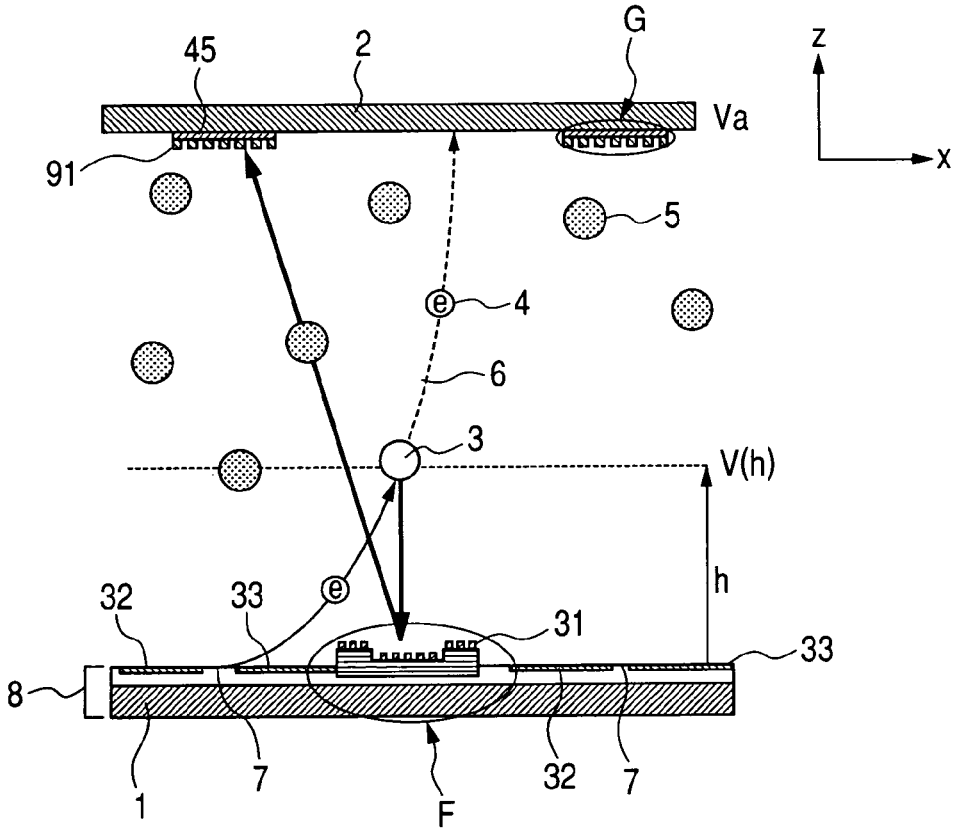
FIGS. 11A, 11B and 11C are views showing a cross section of another example of the image forming apparatus shown in FIG. 1.
Figure 11B:
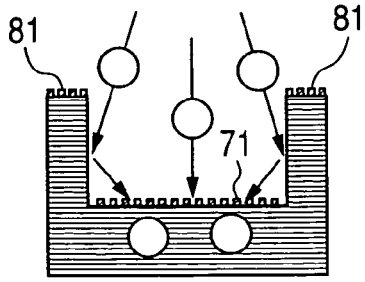
Figure 11C:
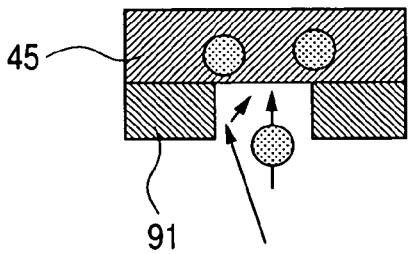

FIGS. 11A, 11B and 11C are views showing a cross section of the image forming apparatus shown in FIG. 1; FIG. 11A is a view showing a part thereof; FIG. 11B is an enlarged view of a part F shown in FIG. 11A; and FIG. 11C is an enlarged view of a part G shown in FIG. 11A.

As shown in FIGS. 11A, 11B and 11C, the present example differs from the fifth example only in that a recess is formed on the column wiring 31 and the side face and the bottom face of the recess is made of Ti 71 and the other regions are made of Ta 81.

The electron beam deflection mechanism and the ion trapping mechanism of the present example are described.

The column wiring 31 manufactured based on the present example was set to have a height of 25 μm and the depth of the recess of 15 μm. The width and the height of the column wiring 31 are suitably defined according to the initial velocity vectors of electron beams, a voltage applied to the face plate 2, the distance between the face plate 2 and the rear plate 8, and the like without being limited to the present example. Moreover, the preferable range of the recess was within that of from several μm to several tens μm. Furthermore, as shown in FIGS. 11A, 11B and 11C, a suitable mask was severally put on, and a film of the Ti 71 and a film of Ta 81 were formed to be 1 μm in thickness severally on the bottom face of the recess of the column wiring 31 and the top face thereof, respectively, by sputtering. On the other hand, after the manufacture of the face plate 2, Al was evaporated on the phosphor film 44 as the metal back 45 using a suitable mask. After that, using a mask in the shape of a stripe, Al was further evaporated so as to be formed to have a cross sectional shape shown in FIGS. 11A, 11B and 11C. A preferable range of the recess is that of from several μm to several tens μm. After that, using a mask in the shape of a stripe, Ti 91 was evaporated to have a cross sectional shape shown in FIGS. 11A, 11B and 11C. After the manufacture of the display panel, the voltages 0 V, 15.5 V and 10 kV were applied to the device electrodes (on the lower voltage side) 32 through the row wiring 42 shown in FIG. 1, the device electrodes (on the higher voltage side) 33 through the column wiring 31, and the high voltage terminal Hv shown in FIG. 1, respectively. Thereby, as shown in FIGS. 11A, 11B and 11C, the electron orbit 6 was settled on the column wiring 31 at any heights h without passing the position above the adjacent device.

Thereby, the electron-emitting devices 7 hardly received the damages by the ionized inert gas ions 3. Moreover, many of the ionized inert gas ions 3 collided with the column wiring 31. However, because the surface of the column wiring 31 was made of Ta 81 having an atomic weight being nearly three times as large as that of Cu, which was the wiring material, the ratio of the ions reflected onto the side of the opposed face plate 2 as a neutral gas became large when the ionized inert gas ions 3 collided with the surface of the column wiring 31. Furthermore, because the reflection directions became diffusion reflection, the reflected ions flew into the regions other than the regions right above the column wiring 31. The inert gas 5 having flown onto the face plate 2 penetrated the surface of the face plate 2. Although there is also a case where another inert gas 5 had flown on the penetrated surface, the inert gas 5 was diffusedly reflected on the column wiring 31. Consequently, the density of the penetrated inert gas 5 became smaller than that of the inert gas ions 3 colliding with the column wiring 31, and the possibility of re-emission was small. Moreover, the inert gas 5 having flown onto the metal back 45 penetrated the bottom face of the recess. By the inert gas 5 colliding with the side face, Ti 91 of the surface thereof was sputtered to be deposited on the bottom face. Thereby, the re-emission of the inert gas 5 from the bottom face was prevented. At the same time, active gases were absorbed by the sputtered Ti 91, and also the exhaust of the active gases was able to be performed besides the exhaust of the inert gas 5. On the other hand, when the inert gas 5 collided with the recessed bottom face of the column wiring 31, the inert gas 5 was embedded in the bottom face by the similar operation to that of the first embodiment.

By such an electron beam deflection mechanism and an ion trapping mechanism, the deterioration of the electron-emitting devices 7 is suppressed, and the image display apparatus of a long life can be obtained. In addition to the effects of the fifth example, because the exhaust of the inert gas 5 is effectively performed and the inert gas 5 is embedded in a wide region, the life of the exhaust effect of the inert gas 5 becomes longer, and then the image display apparatus having a further longer life can be obtained.

Incidentally, although only the column wiring 31 has been described in the present example, the same method of thinking can be applied to the row wiring 42.

Example 7

Figure 12A:
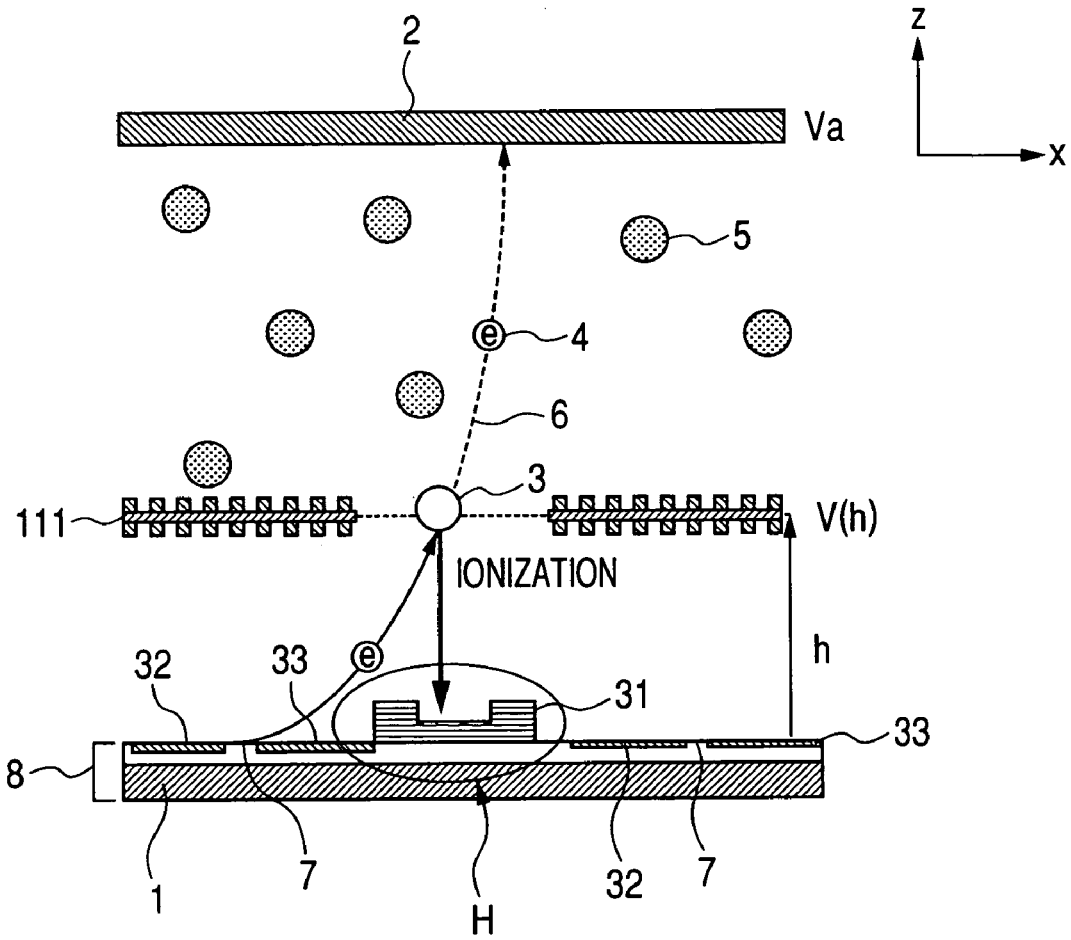
FIGS. 12A and 12B are views showing a cross section of a seventh example of the image forming apparatus shown in FIG. 1.
Figure 12B:
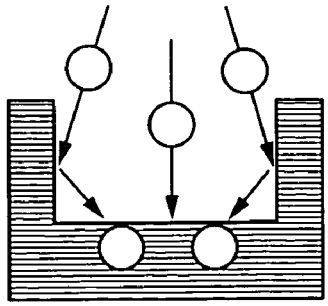

FIGS. 12A and 12B are views showing a cross section of a seventh example of the image forming apparatus shown in FIG. 1; FIG. 12A is a view showing a part thereof; and FIG. 12B is an enlarged view of a part H shown in FIG. 12A.

As shown in FIGS. 12A and 12B, the present example differs from the fist example only in that a grid 111 having recesses is provided between the face plate 2 and the rear plate 8.

The electron beam deflection mechanism and the ion trapping mechanism of the present example are described.

The column wiring 31 manufactured based on the present example was set to have a height of 25 μm and the depths of the recesses of 15 μm. The width and the height of the column wiring 31 are suitably defined according to the initial velocity vectors of the electron beams, the voltage applied to the face plate 2, the distance between the face plate 2 and the rear plate 8, and the like without being limited to those of the present example. Moreover, a preferable range of the recess is that of from several μm to several tens μm. The grid 111 was installed between the face plate 2*a* and the rear plate 8. An aperture of the grid 111 was made to coincide with the width of the column wiring 31. As the grid 111, a grid made by forming grooves each having a width of 10 μm and a depth of 10 μm at a 20 μm pitch on a Ti plate of 100 μm in thickness which has an aperture having the same width as the width of the column wiring 31 in the shape of a stripe was used.

Voltages of 0 V, 15.5 V and 10 kV were applied to the device electrodes (on the lower voltage side) 32 through the row wiring 42 shown in FIG. 1, the device electrodes (on the higher voltage side) 33 through the column wiring 31, and the high voltage terminal Hv shown in FIG. 1, respectively. Thereby, as shown in FIGS. 12A and 12B, the electron orbit 6 was settled on the column wiring 31 at any heights h without passing the position above the adjacent device.

Thereby, the electron-emitting devices 7 hardly received damages by the ionized inert gas ions 3. Moreover, many of the ionized inert gas ions 3 collided with the column wiring 31, and penetrated the inside of the column wiring 31. The inert gas ions 3 having collided with the side face of the recess of the column wiring 31 were made to have higher sputter effect of beating and driving out the material of the surface of the column wiring 31, and the material to be sputtered was deposited on the bottom face. Thereby the re-emission of the inert gas ions 3 from the bottom face can be prevented.

Moreover, the inert gas ions 3 which reflected on the column wiring 31 to become the inert gas 5 after the collision with the column wiring 31 collided with the grid 111, and were embedded in the surface thereof. The embedded ions prevented the re-emission by the same operation of the recess of the column wiring 31.

By such an electron beam deflection mechanism and an ion trapping mechanism, the deterioration of the electron-emitting devices 7 is suppressed, and the image display apparatus of a long life can be obtained. By the provision of the grid 111 in addition to the first example, the embedded region of the inert gas is widened to improve the exhaust effects, and the life of the exhaust becomes longer.

Incidentally, although only the column wiring 31 has been described in the present example, the same method of thinking can be applied to the row wiring 42.

Moreover, without being limited to the present example, it is possible to achieve the improvement of the efficiency of the exhaust by providing the structures of the recesses according to the first to the fourth examples, a Ti film or a Ta film.

Example 8

Figure 13:
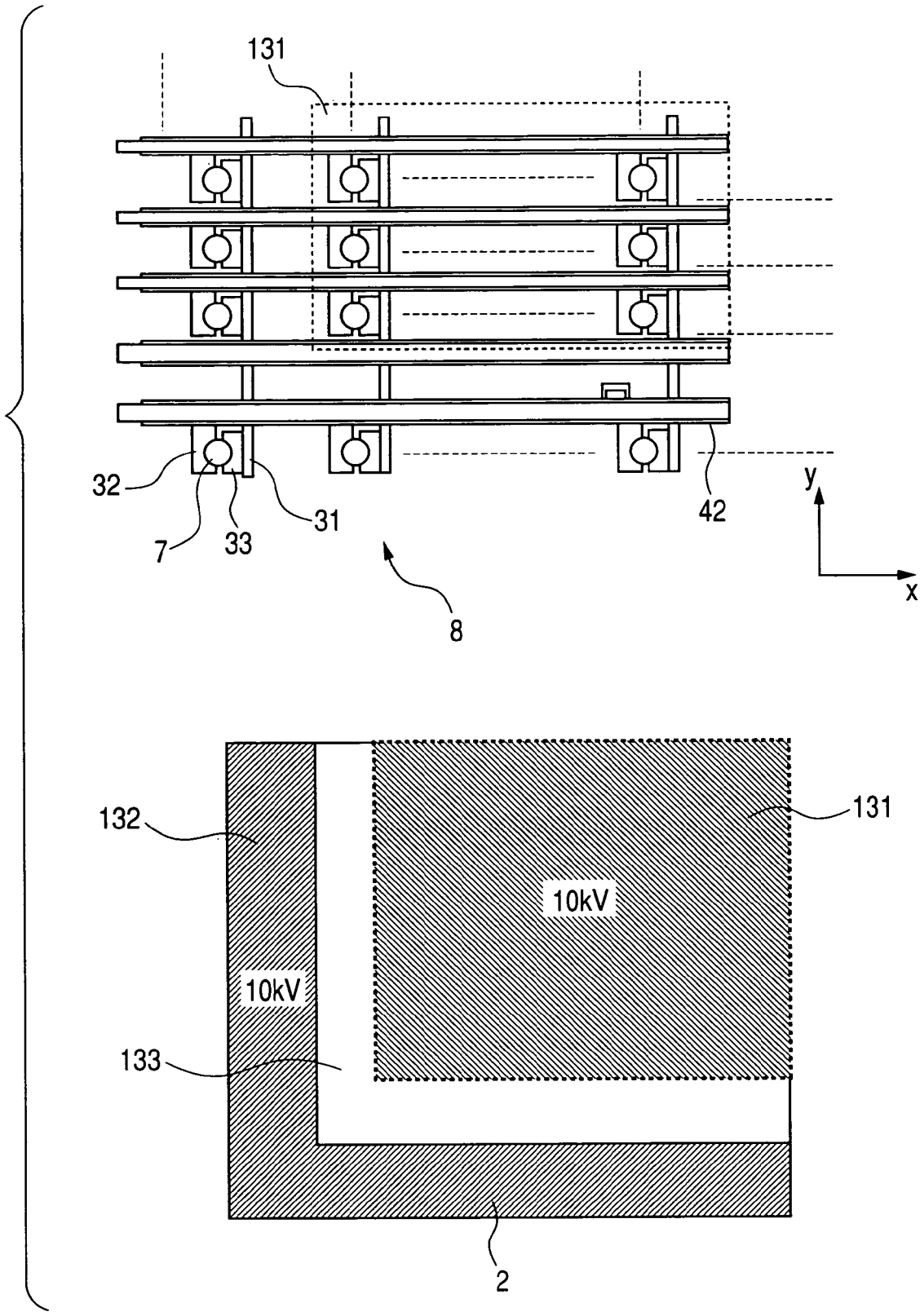
FIG. 13 is a view showing the configurations of a face plate 2 and a rear plate 8 in an eighth example of the image forming apparatus shown in FIG. 1.

FIG. 13 is a view showing the configuration of the face plate 2 and the rear plate 8 in an eighth example of the image forming apparatus shown in FIG. 1.

As shown in FIG. 13, the present example differs from the example 1 in that electron-emitting units, electron beam deflection mechanisms and ion trapping mechanisms are provided also on the outside of an image display region 131.

On the face plate 2, an anode electrode 132 was formed out of the image display region. The face plate 2 was configured in order that a voltage might be severally applied to each of the anode electrode 132 located out of the image display region and the anode electrode located in the image display region 131 by forming a high resistance film 133 between the anode electrode 132 and the anode electrode in the image display region 131.

By such an electron beam deflection mechanism and an ion trapping mechanism, the deterioration of the electron-emitting devices 7 is suppressed, and the image display apparatus of a long life can be obtained. By providing the electron-emitting units, the electron beam deflection mechanisms and the ion trapping mechanisms on the outside of the image display region 131 in addition to the configuration of the first example, it becomes possible to trap the inert gas 5 not only on the inside of the image display region 131 but also on the outside of the image display region 131, and the effect of the exhaust of the inert gas 5 is raised to elongate the life of the exhaust.

Example 9

Figure 14A:
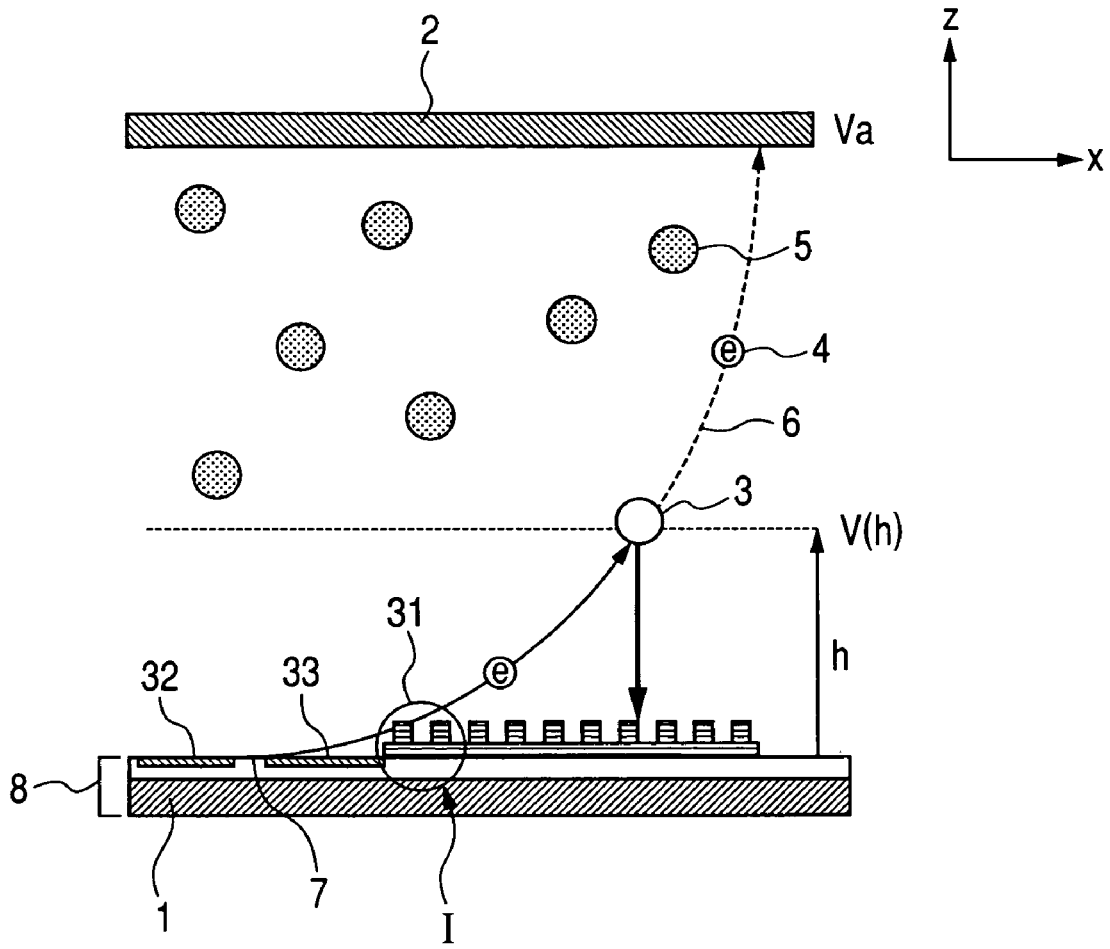
FIGS. 14A and 14B are views showing a cross section of a ninth example of the image forming apparatus shown in FIG. 1.
Figure 14B:
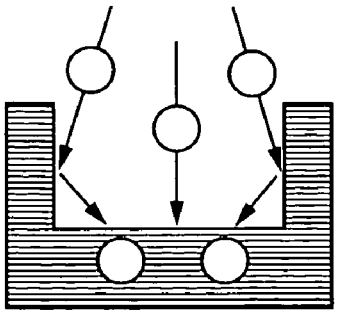

FIGS. 14A and 14B are views showing a cross section of a ninth example of the image forming apparatus shown in FIG. 1; FIG. 14A is a view showing a part thereof; and FIG. 14B is an enlarged view of a part I shown in FIG. 14A. Moreover, FIG. 15 is a view showing the configurations of the face plate 2 and the rear plate 8 in the ninth example of the image forming apparatus shown in FIG. 1.

Figure 15:
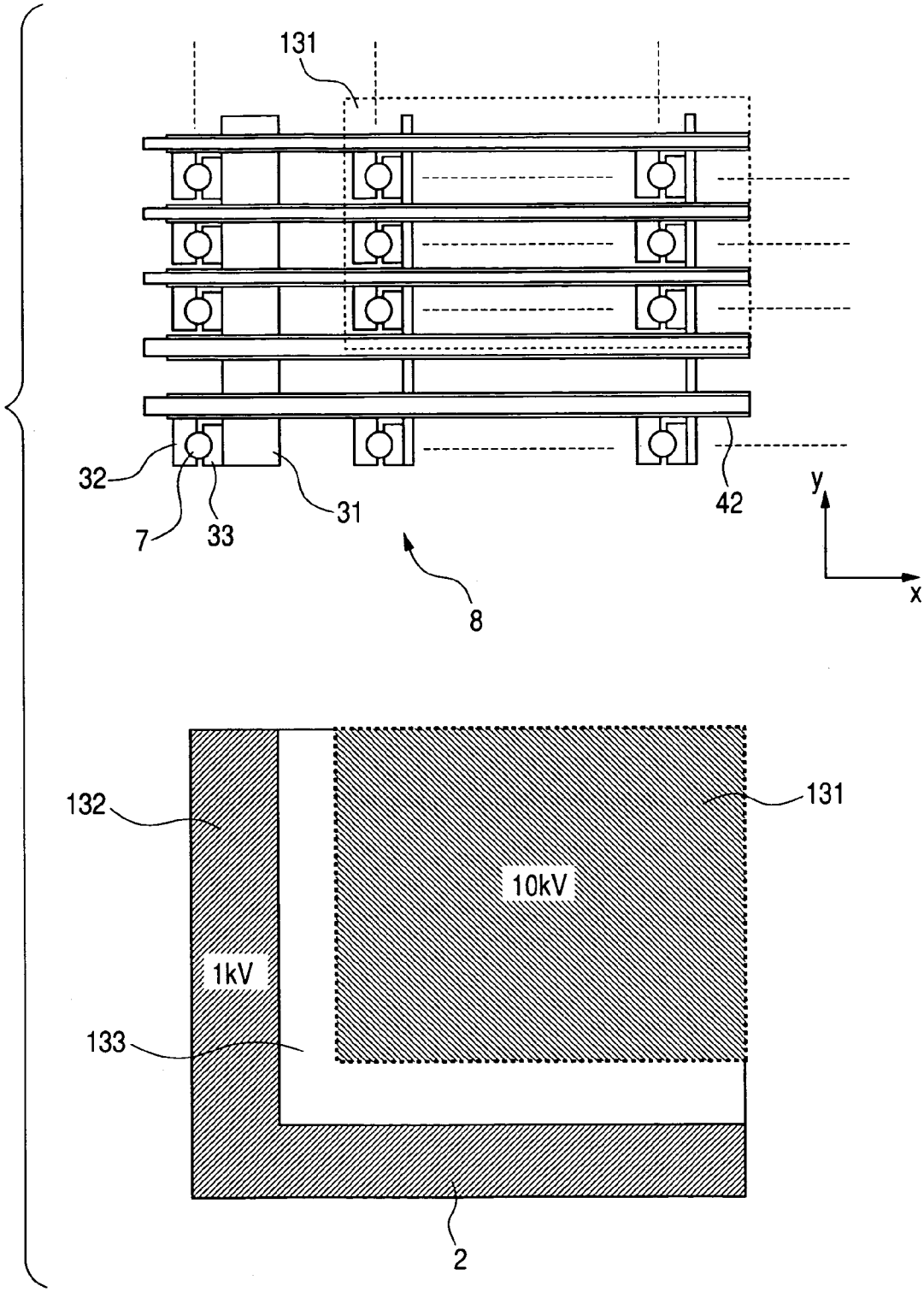
FIG. 15 is a view showing the configurations of the face plate 2 and the rear plate 8 in the ninth example of the image forming apparatus shown in FIG. 1.

As shown in FIGS. 14A, 14B and 15, the present example differs from the eighth example in that a structure and an application voltage which are suitable for ion trapping are set on the outside of the image display region 131.

The electron beam deflection mechanism and the ion trapping mechanism of the present example are described.

Electron emitting units, electron beam deflection mechanisms and iron trapping mechanisms were formed on the inside and on the outside of the image display region 131 based on the present example. The manufactured column wiring 31 was set to have a height of 25 μm, and the depth and width of the recess were set to be severally 15 μm. The width of the column wiring 31 was several tens μm in the inside of the image display region 131, but 300 μm on the outside of the image display region 131. After the manufacture, the voltages 0 V, 15.5 V and 1 kV were applied to the device electrodes (on the lower voltage side) 32 through the row wiring 42, the device electrodes (on the higher voltage side) 33 through the column wiring 31, and the anode electrode 132 out of the image display region, respectively. In comparison with the first example, the high voltages of the electron emission units, the electron beam deflection mechanisms and the ion trapping mechanisms which were provided on the outside of the image display region 131 were made to be lower, and the width of the column wiring 31 on the outside of the image display region 131 was made to be wider. The high resistance film 133 was provided between the anode electrode 132 out of the image display region 131 and the anode electrode in the image display region 131 to be configured to enable the application of different voltages. Furthermore, in order to enable the effective ionization of the inert gas 5, the high voltage to be applied to the anode electrode 132 out of the image display region was lowered. Thereby, the travel for which the electron 4 flew was made to be longer, and an energy region having a large ionized sectional area was used. Moreover, on the outside of the image display region 131, for embedding many inert gas ions 3, the width of the column wiring 31 was set to be wider in comparison with that on the inside of the image display region 131. Moreover, many of the ionized inert gas ions 3 collided with the column wiring 31, and penetrated the inside of the column wiring 31. The inert gas ions 3 having collided with the side face of the recess of the column wiring 31 sputtered the material of the surface of the column wiring 31 to deposit the sputtered material on the bottom face, and thereby the re-emission of the inert gas ions 3 from the bottom face were able to be prevented.

By such an electron beam deflection mechanism and an ion trapping mechanism, the deterioration of the electron-emitting devices 7 is suppressed, and an image display apparatus of a long life can be obtained. By providing the electron-emitting units, the electron beam deflection mechanisms and the ion trapping mechanisms on the outside of the image display region 131 in addition to the configuration of the first example, a structure and an application voltage suitable for the trapping of the inert gas ions 3 ware able to be set, and the exhaust effects of the inert gas 5 ware raised to elongate the life of the exhaust.

Example 10

Figure 16:
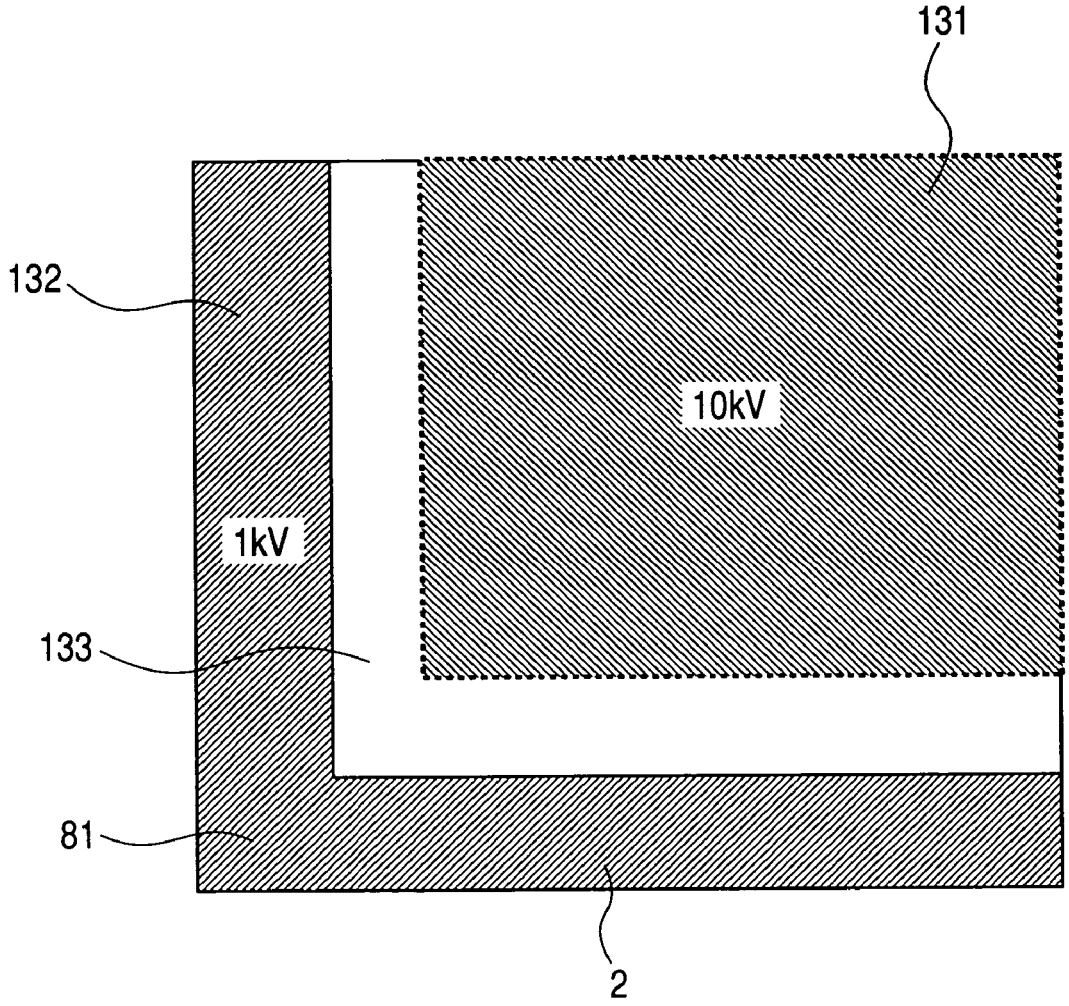
FIG. 16 is a view showing the configuration of the face plate 2 in a tenth example of the image forming apparatus shown in FIG. 1.

FIG. 16 is a view showing the configuration of the face plate 2 in a tenth example of the image forming apparatus shown in FIG. 1.

As shown in FIG. 16, the present example differs from the eighth example in that a material having an atomic weight of 100 or more, which has high reflectance of ions, are provided on the surface of the face plate 2 on the outside of the image display region 131.

By providing Ta film 81 on the surface of the anode electrode 132 out of the image display region, the neutral gas which had been unable to be trapped by the inert gas trapping mechanisms on the rear plate 8 and had been reflected on the rear plate 8 was again reflected to the rear plate 8 side, where the inert gas trapping mechanism was formed, on the face plate 2.

By such a configuration, the trapping quantity of the inert gas 5 on the outside of the image display region 131 increases, and the damages of the electron-emitting devices 7 on the inside of the image display region 131 are further decreased.

Example 11

Figure 17A:
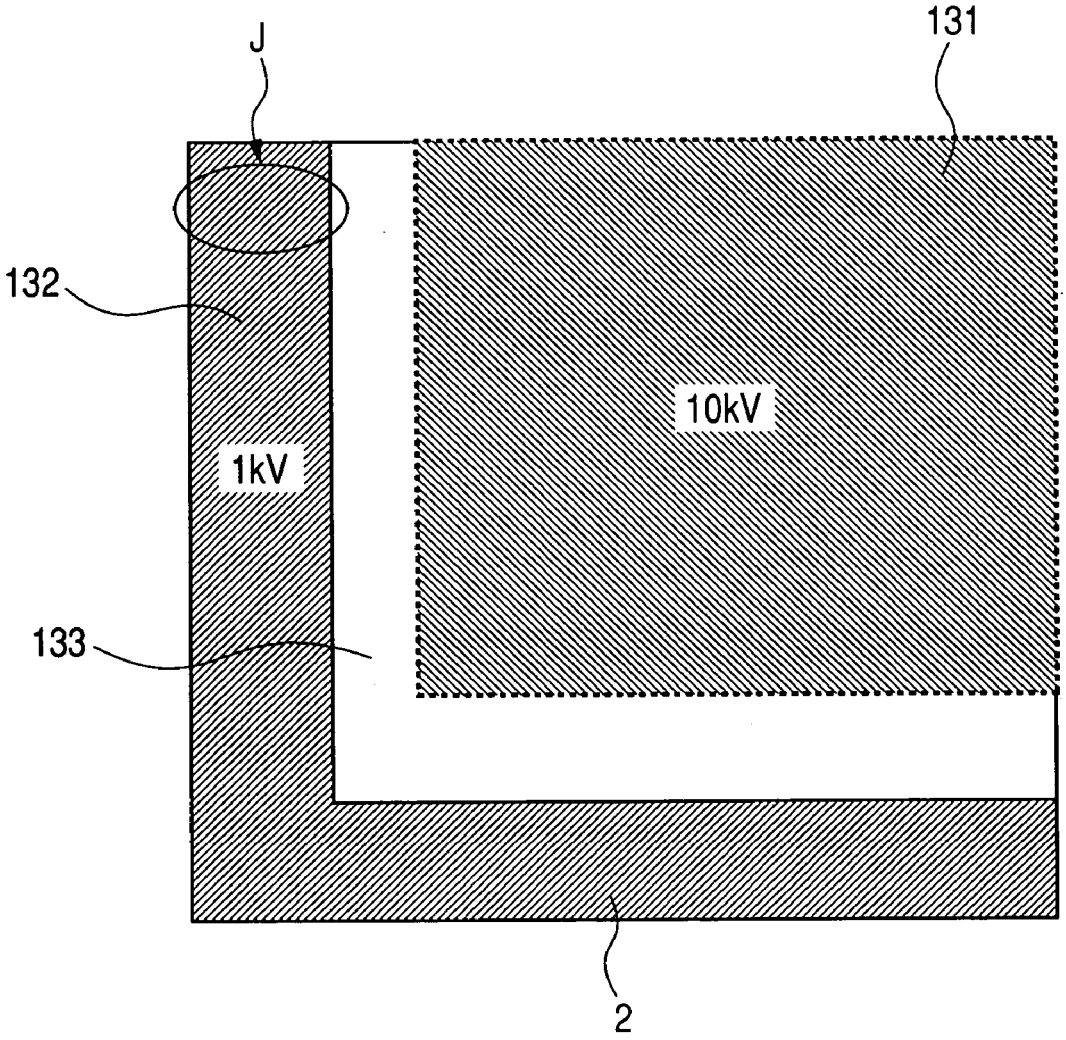
FIGS. 17A and 17B are views showing the configuration of the face plate 2 in an eleventh example of the image forming apparatus shown in FIG. 1.
Figure 17B:
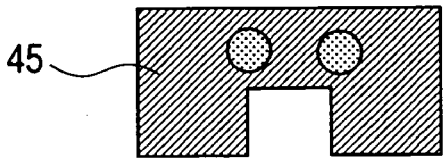

FIGS. 17A and 17B are views showing the configuration of the face plate 2 in an eleventh example of the image forming apparatus shown in FIG. 1; FIG. 17A is a view showing the surface thereof; and FIG. 17B is an enlarged view of a part J shown in FIG. 17A.

As shown in FIGS. 17A and 17B, the present example differs from the eighth example in that recesses are formed on the surface of the face plate 2 formed on the anode electrode 132 out of the image display region.

By forming a plurality of recesses on the surface of the face plate 2 of the anode electrode 132 out of the image display region, a neutral gas which had been unable to be trapped by the inert gas trapping mechanism on the rear plate 8 and had been reflected was reflected again to the rear plate 8 side, where the inert gas trapping mechanism is provided, on the face plate 2.

Thereby, the trapping quantity of the inert gas 5 on the outside of the image display region 131 increases, and the damages of the electron-emitting devices in the inside of the image display region 131 are further decreased.

This application claims priority from Japanese Patent Application No. 2004-310740 filed on Oct. 26, 2004, which is hereby incorporated by reference herein.

What is claimed is:

1. An image forming apparatus comprising:

a rear plate having a pair of device electrodes, an electron-emitting device being put between the pair of device electrodes, and a row wiring electrically connected to one electrode of the pair of device electrodes and applied with a first electric potential and a column wiring, intersecting the row wiring, electrically connected to the other electrode of the pair of device electrodes and applied with a second electric potential that is higher than the first electric potential;

a face plate having an image displaying member irradiated with the electrons emitted from the electron-emitting device, wherein the rear plate and the face plate are arranged opposing to each other with a space maintained at a high vacuum in between, and the face plate is applied with a third electric potential that is higher than the second electric potential; and a deflector, including the pair of the device electrodes, the column wiring, the row wiring and the face plate, which deflects the electrons emitted from the electron-emitting device with an electric field generated in the space by the first, second, and third electric potentials;

wherein the column wiring has, on its surface, a recess for trapping at least Ar gas existing in the space, wherein the recess has a pair of side faces having a sheer portion respectively, and a bottom face between the side faces, and has a depth in the range from several μms to several tens of μms, wherein the side faces and the bottom face are exposed to the space maintained at the high vacuum, wherein the deflector moves the electrons emitted from the electron-emitting device to a position right above the recess, and a portion of the image displaying member located right above the recess is irradiated by the electrons emitted from the electron-emitting device.

2. An image forming apparatus according to claim 1, wherein the surface of the wiring is made of Ti.

3. An image forming apparatus according to claim 1, wherein the column wiring itself or the surface of the column wiring is made of a material having an atomic weight of 100 or more.

4. An image forming apparatus according to claim 1, wherein said side faces and said bottom face of the recess is made of Ti and other surfaces of said column wiring are made of Ta.

5. An image forming apparatus according to claim 1, wherein the deflected electrons ionize the Ar gas existing in the space at the position right above the recess, a material of the side face is sputtered by the ionized Ar gas, and the sputtered material deposits on the bottom face with burying the ionized Ar gas in the bottom face.

6. An image forming apparatus according to claim 1, wherein the recess captures ionized Ar.

7. An image forming apparatus comprising:

a rear plate having a pair of device electrodes, an electron-emitting device being put between the pair of device electrodes, and a row wiring electrically connected to one electrode of the pair of device electrodes and applied with a first electric potential and a column wiring, intersecting the row wiring, electrically connected to the other electrode of the pair of device electrodes and applied with a second electric potential that is higher than the first electric potential;

a face plate having an image displaying member irradiated with the electrons emitted from the electron-emitting device, wherein the rear plate and the face plate are arranged opposing to each other with a space maintained at a high vacuum in between, and the face plate is applied with a third electric potential that is higher than the second electric potential; and a deflector including the pair of the device electrodes, the column wiring, the row wiring and the face plate which deflects the electrons emitted from the electron-emitting device with an electric field generated in the space by the first, second, and third electric potentials;

wherein the column wiring has, on its surface, a recess for trapping at least Ar gas existing in the space, and the column wiring itself or the surface of the column wiring is made of a material having an atomic weight of 100 or more, wherein the recess has a pair of side faces having a sheer portion respectively, and a bottom face between the side faces, and has a depth in the range from several μms to several tens of μms, wherein the side faces and the bottom face are exposed to the space maintained at the high vacuum, and the recess has a depth in the range from several μms to several tens of μms, wherein the deflector moves the electrons emitted from the electron-emitting device to a position right above the recess, and a portion of the image displaying member located right above the recess is irradiated by the electrons emitted from the electron-emitting device, wherein the face plate has, on its surface, a plurality of recesses for trapping the Ar, wherein each of the plurality of recesses on the face plate has a pair of side faces having a sheer portion respectively, and a bottom face between the side faces, and has a depth in the range from several μms to several tens of μms, and wherein the side faces and the bottom face are exposed to the space maintained at the high vacuum.

8. An image forming apparatus according to claim 7, wherein at least a part of each of the plurality of recesses are made of Ti.

* * * * *